US010100620B2

(12) United States Patent
Braddick

(10) Patent No.: US 10,100,620 B2
(45) Date of Patent: Oct. 16, 2018

(54) DOWNHOLE TUBULAR EXPANSION TOOL AND METHOD FOR INSTALLING A TANDEM CLAD LINER

(71) Applicant: TIW Corporation, Houston, TX (US)

(72) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 212 days.

(21) Appl. No.: 15/169,339

(22) Filed: May 31, 2016

(65) Prior Publication Data

US 2017/0342811 A1 Nov. 30, 2017

(51) Int. Cl.
*E21B 43/10* (2006.01)
*E21B 23/01* (2006.01)

(52) U.S. Cl.
CPC ..... *E21B 43/105* (2013.01); *E21B 23/01* (2013.01); *E21B 43/108* (2013.01)

(58) Field of Classification Search
CPC ..... E21B 23/01; E21B 43/105
See application file for complete search history.

(56) References Cited

U.S. PATENT DOCUMENTS 6,622,788 B2 9/2003 Kaiser et al.
6,763,893 B2 7/2004 Braddick
6,814,143 B2 11/2004 Braddick
7,225,880 B2 6/2007 Braddick
7,278,492 B2 10/2007 Braddick
8,132,627 B2 3/2012 Braddick
2005/0230102 A1* 10/2005 Cook ..... B21D 39/203 166/206
2010/0155082 A1* 6/2010 Braddick ..... E21B 23/04 166/380
2010/0155084 A1 6/2010 Watson et al.
2010/0236792 A1* 9/2010 McHardy ..... E21B 23/02 166/382
2016/0097263 A1 4/2016 Thomson

OTHER PUBLICATIONS

International Search Report and Written Opinion issued in related PCT application No. PCT/US2017/034270 dated Aug. 24, 2017, 16 pages.

* cited by examiner

*Primary Examiner* — Caroline N Butcher
(74) *Attorney, Agent, or Firm* — Baker Botts L.L.P.

(57) ABSTRACT

An expansion tool includes a housing and a hydraulic power section for stroking a first expander on a pulling mandrel through a bore of an expandable outer clad, the expansion tool including a ratcheting reaction assembly, having a ratchet rack and a ratcheting component thereon, that engages a proximal end of the outer clad to prevent axial movement of the outer clad as the first expander is drawn through a portion of the bore of the outer clad to expand the outer clad. The ratcheting reaction assembly remains engaged with the proximal end of the outer clad as the housing is repositioned uphole to permit staged expansion of the outer clad using the first expander.

9 Claims, 19 Drawing Sheets

DOWNHOLE TUBULAR EXPANSION TOOL AND METHOD FOR INSTALLING A TANDEM CLAD LINER

BACKGROUND

Field of the Invention

The present invention relates to an expansion tool and method for sequentially expanding the diameter of a first, outer expandable tubular liner and then a second, inner expandable tubular liner together disposed, one inside the other, within a targeted interval of a bore of a casing in an earthen well. More specifically, the present invention relates to an expansion tool and a method to expand a dual clad expandable tubular liner along its full length. The expansion tool and method of the present invention provide for an improved installation of a dual clad expandable tubular liner to seal with the bore of a casing or some other bore without the necessity and expense of recovering a residual and/or non-expanded portion of the dual clad tubular liner from the well to prevent well obstruction. The present invention further relates to an expansion tool and a method for positioning and then restraining the first, outer expandable tubular liner within the targeted installation interval of an earthen bore and then a second, inner expandable tubular liner within the bore of the first, outer expanded tubular liner.

Background of the Related Art

Various tools and methods have been devised for expanding a tubular disposed in an earthen well including, but not limited to, those disclosed in U.S. Pat. Nos. 7,225,880, 7,278,492 and 8,132,627. Some tools are intended to provide a tubular patch in a well, as disclosed in U.S. Pat. Nos. 6,622,788, 6,763,893 and 6,814,143.

An expandable tubular liner used for lining a targeted interval of a well casing may be installed within a casing to provide added structural and/or sealing integrity to an unstable or leaking interval of a casing. An expandable liner may be installed in a targeted interval of casing to isolate a previously perforated, leaking or otherwise open interval of the casing to prevent fluid exchange between the well and one or more adjacent geologic formations penetrated by the well.

Expandable liners may be installed within a targeted interval of a well casing by running an undersized (unexpanded) liner into the targeted interval of the well casing and radially outwardly expanding the liner in-situ. Conventional liner expansion tools include a pulling mandrel that pulls an expander, larger in diameter than the unexpanded liner, from a distal (downhole) end of the liner towards a proximal (uphole) end of the liner. Other liner expansion tools include pushing a mandrel that pushes a connected expander from a proximal end of the liner towards a distal end of the liner. Still other expansion tools rely on hydraulic pressure to generate a force sufficient to displace an expander through the bore of a liner without the use of a mandrel to pull or push the expander.

The liner material and the liner dimensions are generally selected to yield radially outwardly as the expander is moved through the bore to radially expand the liner and to engage the expanded liner with the bore of the targeted casing interval without rupture. The elastic limit of the liner material is exceeded to produce plastic deformation of the liner and to cause the liner to retain an expanded diameter engaged with the bore of the casing. It will be understood that the liner may be expanded slightly beyond the intended diameter in order to elastically resist a residual collapsing force applied by the casing after the expander passes. This mode of installation is optimal for improving the sealing integrity between the exterior surface of the expanded liner and the interior bore of the casing.

Some conventional expansion tools and method involve pulling or pushing the expander through the bore of the expandable liner by engaging the expander on a distal end of an elongate mandrel that is slidably received through a bore of a housing. The mandrel may be hydraulically displaced within the housing to pull the expander into and then through the bore of a liner disposed axially intermediate an expander, connected at the distal end of the mandrel, and a reaction assembly on the expansion tool to oppose movement of the liner during expansion. The expansion tool may be secured or coupled within the casing using a gripping device. The housing and the mandrel may each include a variety of additional features including, but not limited to, annular pistons, annular chambers, connectors, fittings, ball seats and apertures.

A shortcoming of conventional liner expansion tools is that if the slips of the tool are set within the bore of the expandable liner, and if the expandable liner is expanded beginning at an end of the expandable liner that is spaced apart from the portion of the expandable liner in which the slips are set to secure the expandable liner in position, the slips must be eventually displaced from the bore of the liner. This presents a problem because the expandable liner cannot be secured in position for expansion of the full length of the expandable liner, and a portion of the expandable liner will remain in the unexpanded condition. The unexpanded portion may require an additional trip into the well to retrieve the unexpanded portion of the liner.

Those skilled in the metallurgical arts will understand that a metal liner that is radially outwardly expanded to a larger diameter exhibits a predictable amount of axial shrinkage. As the diameter of the liner is expanded, the wall thickness of the liner is substantially reduced and the length of the liner shortens to compensate. This shrinkage may complicate the liner expansion process where slips are set in the bore of the casing above the top of the expandable liner and are used to secure the liner in position against the expander. Shrinkage of the liner may cause unwanted movement or shifting of an expanded portion of the liner within the casing if the reaction assembly cannot be favorably repositioned to compensate for axial shrinkage of the liner, thereby compromising the sealing integrity of the expanded liner. Conventional expansion tools that grip the bore of the casing during liner expansion may include gripping components that remain in a fixed position within the casing during liner expansion. This approach may result in a loss of sealing integrity between the resulting expanded liner and the casing in which the liner is expanded and installed due to the axial shrinkage of the liner that occurs during expansion.

The disadvantages of the prior art are overcome by the present invention, an improved downhole tubular expander and method are herein disclosed.

BRIEF SUMMARY OF THE INVENTION

Embodiments of the apparatus of the present invention can be used to install a dual clad liner within a well casing. Those skilled in the mechanical arts will understand that a layered or clad structure often provides superior burst resistance and collapse resistance as compared to single-layered structures. Embodiment of the apparatus of the present invention can be used to install an outer clad within the well casing by expanding the outer clad in situ within the targeted portion of the well casing and then to install an inner, reinforcing clad within the bore of the outer clad by expanding the inner clad in situ within the bore of the previously expanded outer clad. Embodiments of the apparatus of the present invention can install the dual clad liner in the well casing without the need for removing the apparatus from the well between the installation of the outer clad and the installation of the inner clad, thereby saving considerable rig time.

An expandable liner, such as each of the outer clad and the inner clad installed using the apparatus of the present invention, provides optimal structural and sealing integrity if it is radially expanded along its full length or substantially its full length to radially engage the bore of a targeted interval of the tubular to be reinforced while expanded portions of the expandable liner remain statically engaged with the interior wall of the tubular in which the expandable liner is being installed as the remaining length of the liner is thereafter expanded. In embodiments of the apparatus of the present invention, the outer clad, which is first installed in the interior bore of the targeted interval of the casing, provides improved structural and sealing integrity if the expansion tool is adapted to self-adjust to prevent shifting or movement of a partially-expanded portion of the outer clad within the targeted interval of the bore of the casing. Shifting or movement of the partially expanded liner most often occurs when slips that secure the apparatus in place are set to engage the interior wall of the casing in which the expandable outer clad is being expanded as the expansion tool is repeatedly stroked to expand an interval of the expandable liner, and then re-cocked prior to each subsequent stroke that is needed until the entire expandable liner is expanded in the casing. It will be understood that, at some point during the expansion process, enough of the expandable outer clad will be expanded so that sufficient frictional engagement between the expanded portion of the outer clad and the casing prevents movement of the expanded portion of the outer clad during expansion of the remaining, unexpanded portion of the outer clad. When this threshold is achieved, the remaining, unexpanded portion of the outer clad may be expanded by using the draw works on the rig to pull the expansion tool in the uphole direction, thereby causing the first expander that expands the outer clad to move through the remaining unexpanded portion of the bore of the outer clad until the entire outer clad is expanded along its full length. However, in the event that a tight spot requires an excessive amount of force to be applied to the tubular string by the draw works, the draw works can be stopped and the tubular string can be again pressurized to stroke the hydraulic section of the expansion tool to hydraulically move the first expander within the bore of the outer clad without placing too much stress on the draw works and/or the tubular string. After the tight spot is expanded, the draw works may then be re-engaged to resume expansion of the outer clad by pulling the expansion tool.

Embodiments of the expansion tool and method of the present invention employ slips that are sized and adapted to be set within the casing in which the expandable liner is to be expanded and installed. This enables the expansion tool to retain radially expanded portions of a partially-expanded liner in position within the targeted interval of the bore of the casing and to prevent unwanted shifting or sliding of a partially expanded portion of the outer clad within the targeted interval of the bore of the casing during the expansion process. Embodiments of the expansion tool of the present invention engage an unexpanded proximal end of the outer clad with a self-adjusting reaction assembly that is coupled to a slip cage that is, in turn, coupled to a housing of the expansion tool. The self-adjusting reaction assembly engages the proximal end of the outer clad to oppose an axial displacing force applied by movement of the first expander into and through the distal end and then the distal portion of the bore of the outer clad that is the first portion of the outer clad to be expanded. The reaction assembly self-adjusts to enable re-cocking of the expansion tool for stepwise or staged expansion of the outer clad starting from a distal end of the outer clad and progressing stepwise to the proximal end of the outer clad. A portion of the self-adjusting ratcheting reaction assembly called a ratcheting component is eventually detached from the proximal end of the bore of the outer clad before the first expander exits the bore of the fully expanded outer clad.

One embodiment of the expansion tool and method of the present invention provides an expansion tool that uses a self-adjusting ratcheting reaction assembly to secure an unexpanded outer clad in a run-in configuration on the expansion tool. The embodiment of the expansion tool receives and secures the expandable outer clad to the expansion tool in a run-in configuration at the surface. The expandable outer clad is received onto the expansion tool to engage the ratcheting component of the self-adjusting ratcheting reaction assembly with a proximal end of the expandable outer clad and to surround a portion of the elongate ratchet rack extending distally to the original starting position of a ratcheting component movably received on the exterior of the ratchet rack through which the pulling mandrel passes. The first expander is then connected to an intermediate portion of the pulling mandrel to axially capture the unexpanded outer clad on the expansion tool between the first expander, engaging the distal end of the outer clad, and the ratcheting component of the self-adjusting reaction assembly at the proximal end of the outer clad. The pulling mandrel is slidably received through a bore of the tubular ratchet rack which terminates short of the intermediate portion of the pulling mandrel to allow for stroking of the pulling mandrel towards the ratchet rack during each expansion stroke. This configuration is referred to herein as the run-in configuration of the expansion tool.

Embodiments of the expansion tool of the present invention further includes a pulling mandrel extension having a proximal end coupled to the first expander, a distal end coupled to a second expander that is smaller in diameter than the first, and a bore extending from a proximal end of the pulling mandrel extension through the distal end and the second expander coupled thereto. The bore of the pulling mandrel extension provides an extension to the bore of the pulling mandrel until the ball is landed into the ball seat of the pulling mandrel to isolate the bore of the pulling mandrel to enable the pressurization and use of the hydraulic section of the expansion tool to stroke the pulling mandrel and the pulling mandrel extension. An embodiment of the expansion tool of the present invention further comprises a second expandable liner, or inner clad, that is axially captured on the pulling mandrel extension with a proximal end of the inner clad proximal to or engaged with the first expander and a distal end of the inner clad terminating in a pre-expanded portion of the inner clad that has an interior diameter that is large enough to receive the second expander into the pre-expanded portion. The second expander is larger in diameter than the bore of the inner clad except for the bore of the pre-expanded portion of the inner clad into which the second expander is received in the run-in configuration. The exterior diameter of the inner clad is smaller than the interior diameter of the outer clad in its expanded state; that is, the exterior diameter of the inner clad is smaller than the exterior diameter of the first expander that is pulled through the outer clad to expand the outer clad into engagement with the interior wall of the targeted interval of the casing. The exterior diameter of the pre-expanded portion at the distal end of the inner clad is larger than the interior diameter of the outer clad after it has been expanded by the first expander; that is, the exterior diameter of the pre-expanded portion of the inner clad is larger than the diameter of the first expander. The exterior diameter of the inner clad is smaller than the interior diameter of the outer clad after expansion; that is, the exterior diameter of the inner clad is smaller than the diameter of the first expander that enters into and expands the diameter of the outer clad. The inner clad, unlike the outer clad, is not necessarily concentrically disposed around a ratchet rack and is not necessarily engaged with a ratcheting component or with any other ratcheting device. The pre-expanded portion at the distal end of the inner clad is sized to engage, but not enter, the distal end of the expanded outer clad and to thereby position and restrain the inner clad for being expanded by the second expander within the expanded outer clad. This results in a tandem clad expanded liner including the first-expanded outer clad engaging the interior wall of the targeted interval of the casing and the second-expanded inner clad engaging the interior wall of the expanded outer clad.

The inner clad is pulled, in its unexpanded state, into the expanded bore of the outer clad as the outer clad is expanded by the first expander. The proximal end of the inner clad is disposed proximal to the first expander and the majority of the length of the unexpanded inner clad is of a diameter that is less than the inner diameter of the expanded outer clad. When the pre-expanded portion at the distal end of the inner clad engages the distal end of the expanded outer clad, the pre-expanded portion of the inner clad will not enter the distal end of the expanded primary outer clad and further movement of the pulling mandrel, the pulling mandrel extension connected thereto and the second expander coupled to the distal end of the pulling mandrel extension will draw the second expander from the bore of the pre-expanded portion of the inner clad and into and through the bore of the inner clad. In this manner, the inner clad will be expanded radially outwardly to engage the interior diameter of the expanded outer clad.

It will be understood that when the pre-expanded portion of the inner clad engages the distal end of the expanded outer clad, all or most of the outer clad will have already been expanded by the first expander. This results in a substantial amount of frictional engagement between the expanded outer clad and the interior wall of the targeted interval of the casing, and this frictional engagement will prevent movement of the expanded outer clad as the pre-expanded portion of the inner clad engages and then bears against the distal end of the expanded outer clad as it restrains the inner clad against the force applied by the second expander as it is pulled into and through the bore of the inner clad. The entire inner clad is likely to be expanded by use of the draw works on the rig to pull the tubular string and the housing of the expansion tool connected to the tubular string (not shown) at the proximal end of the expansion tool to pull the pulling mandrel, the pulling mandrel extension and the second expander connected to the pulling mandrel extension through the entire bore of the immobilized inner clad.

The expansion tool, with the unexpanded outer clad and the unexpanded inner clad captured thereon, are run into a well casing on the end of a tubular string stepwise extended into the well from a rig at the earth's surface. The expansion tool is positioned within a section of the casing targeted to be reinforced, stabilized, patched or sealed with a tandem clad expanded liner.

Embodiments of the expansion tool of the present invention include a tubular housing having a proximal end adapted for being connected to a distal end of a tubular string and a distal end coupled to a slip cage and a rack retainer. The housing includes a bore through which an upper portion of a pulling mandrel passes. The bore of the housing includes a plurality of annular cylinders defined by radially inwardly extending and spaced apart annular stops. The pulling mandrel has a bore and a plurality of radially outwardly extending annular pistons that are reciprocatably received within the annular cylinders defined within the bore of the housing. This axially aligned arrangement of hydraulic cylinders is known in the art.

The pulling mandrel of an embodiment of an apparatus of the present invention includes an upper portion and a lower portion. A pulling mandrel extension extends from the first expander, disposed at a distal end of the pulling mandrel, to a second expander, disposed at a distal end of the pulling mandrel extension.

The rack retainer is coupled to the slip cage which is coupled to the distal end of the housing. The rack retainer includes a bore through which a portion of the pulling mandrel passes. The rack retainer movably secures the self-adjusting reaction assembly to the slip cage and to the housing. The ratchet rack, a component of the self-adjusting reaction assembly, threadably cooperates with the ratcheting component to permit uni-directional movement of the ratcheting component from a retracted position on the ratchet rack, proximal to the slip cage and the housing, to an extended position on the ratchet rack that is distal to the slip cage and the housing to vary (increase) the distance from the ratcheting component, which is removably connected to the proximal end of the outer clad, to the slip cage and housing during the outer clad expansion process. The reaction assembly of the expansion tool of the present invention includes the elongate ratchet rack having a threaded exterior and a bore through which the lower portion of the pulling mandrel passes. The reaction assembly further includes a ratcheting component having a ratchet ring housed within a ring housing. The ratchet ring includes a radially interior threaded portion and a longitudinal slot. The interior threads of the ratchet ring correspond to the exterior threads along the ratchet rack. The ratchet ring is spring biased to collapsibly engage the interior threaded portion with the exterior threaded portion of the ratchet rack. The ring housing includes an interior chamber that accommodates cyclic expansion of the ratchet ring, to permit thread skipping in one direction only, and collapse or contraction of the ratchet ring. The ratchet housing surrounds the spring-biased ratchet ring. The ratchet housing is secured to the proximal end of the outer clad using, for example, threaded fasteners.

In one embodiment of the apparatus of the expansion tool, the ratchet ring includes a bore with buttress threads adapted to cooperate with corresponding buttress threads disposed along the exterior of the elongate ratchet rack to oppose movement of the ratchet rack in a distal direction relative to the ratcheting component and the expandable liner connected thereto, but to allow movement of the ratchet rack in a proximal direction relative to the ratcheting component and the expandable outer clad connected thereto. The ratcheting component may comprise an exterior surface such as, for example, the ring housing, adapted for being releasably engaged with the unexpanded proximal end of the bore of the outer clad. For example, the ring housing of the ratcheting component may include external threads or other surface gripping structures and/or bonding agents. In one embodiment, the ring housing of the ratcheting component is secured to the unexpanded proximal end of the expandable outer clad with threaded and headless fasteners, as illustrated in the appended drawings. The uni-directional movement of the ratchet rack within and relative to the ratcheting component (including the ratchet ring and the ring housing that surrounds the ratchet ring) can, in one embodiment, be provided by the use of buttress threads disposed along the ratchet rack and cooperating buttress threads disposed within the bore of the slotted ratchet ring. The longitudinal slot of the ratchet ring resiliently opens (expands) and closes (contracts or collapses) to allow the ratchet rack to move within the ratchet ring and the ring housing in the proximal direction (relative movement), but to prevent movement of the ratchet rack within the ratchet ring and the ring housing in the distal direction (relative movement). It will be understood that cooperative sets of buttress teeth can provide for this uni-directional ratcheting function. These features are discussed in more detail below and illustrated in the appended drawings.

The self-adjusting reaction assembly of embodiments of the expansion tool of the present invention allows the housing and the hydraulic annular cylinders formed therein, along with the slip cage and the slips movably captured therein, to be repositioned further uphole between each stage of hydraulically assisted outer clad expansion without disengaging the reaction assembly from the unexpanded proximal end of the outer clad. At the onset and during the earlier stages of the outer clad expansion process, the pulling mandrel is hydraulically displaced proximally within the bore of the housing and the slip cage to first set the slips to secure the expansion tool within the casing, and then to pull the first expander through a portion or an interval of the bore of the expandable outer clad. The ratcheting component reacts against the proximal end of the outer clad to oppose any shifting or movement of the outer clad within the casing due to the axial component of the force applied to the outer clad by the first expander. During an expansion stroke of the pulling mandrel and the expander connected thereto, the ratcheting component may move in a distal direction relative to the ratchet rack to compensate for axial shrinkage of the expandable outer clad occurring during radial expansion by the first expander. It will be understood by persons knowledgeable in metallurgy that the expansion of a slender tubular member, such as the outer clad, generally results in a corresponding reduction in the length, or shrinkage, of the tubular member to compensate for radial expansion which reduces wall thickness.

The expansion tool of the present invention includes slips to grip the bore of the casing and to secure the housing, the slip cage, the rack retainer, and the reaction assembly in a position within the casing. As explained above, the reaction assembly prevents axial movement of the outer clad, except for the capacity of the reaction assembly to accommodate outer clad axial shrinkage. Hydraulic pressurization of the bore of the pulling mandrel results in axial displacement of the pulling mandrel relative to the housing. At the very onset of hydraulic pressurization of the hydraulic section of the expansion tool, the pulling mandrel may move in a proximal direction while the housing may move in a distal direction. That is, until the slips are set within the casing, the housing may also be slightly movable upon pressurization of the tubular string, probably less than about one inch (2.54 cm), in a downhole direction opposite to the initial movement of the pulling mandrel. However, once the slip actuator engages and displaces the slips radially outwardly through windows of the slip cage to engage a gripping face of each of the slips with the interior bore of the casing, the slip cage and the housing coupled to the slip cage become secured in position in the casing. Further movement of the pulling mandrel in the proximal direction pulls the first expander through a distal portion of the bore of the expandable outer clad, which is secured against movement in the proximal direction by the reaction assembly, slips and slip cage.

After completion of an expansion stroke, the annular pistons on the pulling mandrel are hydraulically displaced in a proximal direction to proximal ends of the annular cylinders formed within the housing. The first expander on the distal end of the pulling mandrel is sized so that when it is drawn through a portion of the bore of the expandable outer clad, it remains lodged at the end of a stroke within a freshly expanded portion of the expandable outer clad which is, in turn, lodged in the bore of the casing in which the expandable outer clad is to be expanded. The pressure of the fluid in the bore of the pulling mandrel and in the portions of the annular cylinders distal to the annular pistons is relieved. The draw works on the rig at the surface then pulls the tubular string that is connected at its distal end to the housing of the expansion tool and, through the housing, it also pulls the slip cage in a proximal direction, or uphole, to unseat the slips from gripping engagement with the casing. The draw works on the rig is then used to pull the housing further in an uphole direction to reposition the housing, the annular cylinders therein and the rack retainer in a proximal direction, or uphole, to restore each of the annular pistons on the lodged pulling mandrel to their original "cocked" positions at the distal ends of each of the annular cylinders of the housing. This process uses the frictional resistance to movement of the lodged first expander, the expanded portion of the expandable liner disposed around the first expander and the pulling mandrel to which the first expander is connected to re-cock the hydraulic section of the housing by moving the housing relative to the pulling mandrel.

The pulling mandrel is again hydraulically actuated by fluid pressurization of the bore of the tubular string to again deploy the slips to grip the bore of the casing at a position spaced uphole from the first gripping position, and further to displace the first expander in a proximal direction, relative to the housing and the slip cage, through a second portion of the expandable outer clad. The expander is again lodged within the freshly expanded portion of the expandable outer clad which is, in turn, lodged within the casing in which the outer clad is being expanded. The process is repeated and the expandable outer clad is stepwise expanded, interval by interval, with each expanded interval of the outer clad being generally equal in length to the stroke of a plurality of annular pistons on the pulling mandrel within the corresponding plurality of annular cylinders of the housing. This stepwise expansion process continues until the entire length of the expandable outer clad is expanded and the reaction assembly is disconnected from the proximal end of the expandable outer clad.

The bore of the pulling mandrel includes a plurality of strategically positioned apertures immediately distal to each of the annular pistons on the pulling mandrel. Pressurization of the fluid in the bore of the tubular string that is used to position the expansion tool in the well and of the bore of the pulling mandrel in fluid communication with the tubular string provides fluid pressure through the apertures into adjacent annular cylinders of the housing. The fluid pressure provides the power to fluidically displace the annular pistons on the pulling mandrel in a proximal direction within the annular cylinders of the housing. Similarly, there are vents in the housing at the proximal end of each of the annular cylinders that allow fluid to be displaced from the annular cylinders as the annular pistons on the pulling mandrel are hydraulically displaced by the pressure in the distal portion of each annular cylinder.

It will be understood that the bore of the pulling mandrel is open as the expansion tool is run into the well and positioned within the casing at the targeted interval of the bore of the casing. The open bore of the pulling mandrel enables the operator of the well to maintain well control at all times during running and positioning of the expansion tool. The bore of the pulling mandrel can be closed to enable the bore of the pulling mandrel, and the annular pistons in fluid communication with the bore of the pulling mandrel, to be pressurized in order to stroke the expansion tool and displace the pulling mandrel and first expander relative to the housing. The pulling mandrel includes a ball seat disposed intermediate the plurality of apertures that provide fluid pressure to the annular cylinders of the housing and the second expander at the distal end of the pulling mandrel extension. The ball seat is adapted to receive a ball introduced into the tubular string and pumped through the tubular string and the bore of the pulling mandrel to engage and seal with the ball seat. The ball is deployed from the rig through the tubular string and into the bore of the pulling mandrel after the expansion tool and the outer clad thereon are favorably positioned in the targeted interval of the bore of the casing. Once the ball engages and seals with the ball seat, pressurized fluid pumped through the tubular string and into the bore of the pulling mandrel communicates through the apertures to the annular cylinders to apply fluid pressure against the distal face of the annular pistons on the pulling mandrel.

After the expansion tool is stroked to draw the first expander into the bore of the expandable outer clad to expand an initial and distal portion of the expandable outer clad, the fluid pressure within the tubular string and the bore of the pulling mandrel is relieved. Relieving the pressure in the bore of the pulling mandrel relieves the pressure urging the slips into the gripping position with the bore of the casing. The draw works of the rig is used to pull the tubular string and the housing of the expansion tool connected to the tubular string towards the surface end of the well as the tightly lodged first expander, pulling mandrel and partially expanded outer clad remain in place in the casing. The slips are thereby unseated and retract to allow the housing, slip cage and the rack retainer coupled thereto to be repositioned uphole. Repositioning of the housing, slip cage and rack retainer, with the pulling mandrel and first expander remaining lodged in place in the outer clad and the casing, re-cocks the expansion tool and positions the pulling mandrel for another stroke to further expand an additional interval of the outer clad. During the re-cocking process, the housing and the annular chambers formed therein move in a proximal direction relative to the stationary annular pistons that remain in place with the lodged expander, the partially expanded liner and the pulling mandrel to which the expander is connected. Once the first expander is drawn into the bore of the expandable outer clad, the first expander remains lodged in an interference fit with the expanded portion of the expandable outer clad, and the expanded portion of the outer clad is circumferentially trapped between the first expander and the bore of the casing in which the expandable outer clad is being installed. The interference fit advantageously lodges the first expander, the pulling mandrel, the annular pistons on the pulling mandrel and the partially expanded outer clad in position within the bore of the targeted interval of the casing as the housing, slip cage and rack retainer are moved in a proximal direction with the tubular string. The ratcheting component, however, remains engaged with the proximal end of the expandable outer clad and it ratchets in a distal direction along the ratchet rack as the housing, the annular chambers and the ratchet rack are pulled uphole during the re-cocking step.

After re-cocking of the expansion tool in preparation for another expansion stroke, the expansion tool is again capable of being hydraulically stroked by pressurizing the tubular string and the bore of the pulling mandrel to hydraulically displace the pulling mandrel and the first expander through another expansion stroke to expand another interval of the expandable outer clad. Upon hydraulic pressurization of the bore of the tubular string and the bore of the pulling mandrel, the slips are initially set to grip the bore of the casing to secure the housing and the rack retainer in place within the casing. The first expander is then drawn through another interval of the bore of the expandable outer clad as the ratcheting component remains engaged with the proximal end of the expandable outer clad to resist movement of the partially expanded outer clad in a proximal direction relative to the ratchet rack. The ratcheting component thereby provides a reaction force against the expandable outer clad to prevent unwanted axial shifting or movement of the partially expanded outer clad during each expansion stroke.

In one embodiment of the expansion tool of the present invention, a reaction assembly includes a ratcheting component and a ratchet rack, and the ratcheting component may include one or more spring elements that bias one or more dogs into engagement with a series of buttress threads disposed along the ratchet rack. Spring biased elements may be disposed circumferentially within the ratcheting component. In other embodiments, the ratcheting component may comprise a circumferentially expandable slotted ratchet ring with a threaded bore and a longitudinal slot, as described herein above. The longitudinal slot of the ratchet ring allows the threaded bore of the ratchet ring to elastically diametrically expand in response to an applied expanding force. The ratchet rack includes an exterior having cooperating threads. In a preferred embodiment, the threads along the exterior surface of the ratchet rack are buttress threads on which the proximal side of each thread is ramped and the distal side of each thread is steep, and the buttress threads of the interior bore of the cooperating slotted ratchet ring are ramped on the distal side and steep on the proximal side. This arrangement of cooperating buttress threads within the bore of the ratchet ring and on the exterior surface of the ratchet rack allows the ratchet ring to ratchet in a distal direction along the ratchet rack as the ramped sides of the mating threads slidably engage to elastically and circumferentially expand the bore of the ratchet ring prior to the ratchet ring passing each thread. Expansion of the longitudinal slot of the ratchet ring allows the threads of the internal bore of the ratchet ring to skip over and slide past threads of the ratchet rack and to move, or ratchet, in a distal direction along the ratchet rack. This ratcheting movement of the ratchet ring occurs as the housing, the slip cage and the ratchet rack are pulled in a proximal direction as the ratchet ring remains secured to the proximal end of the partially expanded outer clad to re-cock the hydraulic section of the expansion tool. At the onset of the subsequent expansion stroke, the axial force applied by the first expander to the outer clad forces the outer clad and the ratchet ring coupled to the proximal end of the outer clad in a proximal direction relative to the ratchet rack, and into binding engagement with the ratchet rack as the steep sides of the cooperating threads engage to oppose expansion and movement of the ratchet ring. It will be understood that at some point during the staged expansion process, the expanded portion of the expandable outer clad will be sufficiently long so that the frictional engagement between the expanded portion of the expandable outer clad and the interior wall of the casing becomes sufficient to prevent movement of the expandable outer clad in response to further movement of the first expander through the bore of the expandable outer clad. At this juncture, the operator may choose to use the draw works on the rig to pull the expansion tool to finish expanding the expandable outer clad.

In embodiments of the expansion tool of the present invention, an expansion stroke initially causes the ratchet rack to be displaced, along with the ratchet ring and relative to the housing and the tubular string, until the slip actuator is moved relative to the slips to displace the slips radially outwardly through the windows in the slip cage to engage with the bore of the casing to prevent movement of the housing, the slip cage and the ratchet rack. Once the slips are firmly engaged with the bore of the casing, further displacement of the pulling mandrel within the housing and the slip cage causes the first expander to be pulled through an interval of the expandable outer clad to radially expand the outer clad within the bore of the casing.

In addition to enabling the expansion tool to be re-cocked, the ratcheting component, which includes the ratchet ring and ring housing, can also move in a distal direction relative to and along the ratchet rack to compensate for the axial shrinkage in the expandable outer clad that occurs as a result of the radial expansion of the expandable outer clad resulting from movement of the first expander. Each time the expansion tool is re-cocked, the ratcheting component remains engaged with the proximal end of the partially expanded outer clad as the ratchet rack moves in a proximal direction relative to the ratcheting component to re-cock the expansion tool. The ratcheting component, which includes the ratchet ring and ratchet housing, therefore serves the dual functions of enabling the tool to be re-cocked between expansion strokes and also compensating for axial shrinkage of the expandable outer clad occurring during an expansion stroke.

The setting of the slips of the expansion tool of the present invention to grip the interior wall of a casing occurs at the onset of an expansion stroke. At the onset of a stroke of the hydraulic section of the expansion tool, the slip actuators, coupled to the housing, are moved in a distal direction relative to the slips and the slip housing in which the slips are axially captured. The slip actuators slidably engage and radially outwardly deploy the slips to engage and grip the interior bore of the casing. The slip cage is coupled to the ratchet rack, and the ratchet rack is thereby secured within the casing by deployment of the slips to the gripping position. The limited amount of relative movement between the housing, coupled to the slip actuators, and the ratchet rack, coupled to the slips, is enabled by a collet assembly having a collet, with a bore therethrough, that is releasably seated within a collet cage, which also has a bore to receive the collet. The collet cage retains the collet within a limited range of axial movement within the collet cage. In one embodiment, the collet includes at least one radially inwardly directed protrusion, or a series of radially inwardly directed protrusions, that is releasably seated within at least one corresponding radially outwardly extending notch, or a series of radially outwardly directed notches, in the exterior of the pulling mandrel that passes through the bore of the collet. The collet is in a seated position within the collet cage when the radially inwardly directed notch of the collet is engaged with the radially outwardly directed notch in the pulling mandrel. The collet cage is coupled to the slip cage and to the ratchet rack. Upon pressurization of the bore of the pulling mandrel, the collet can be moved only a limited distance within the collet cage and then forcibly disengaged from the pulling mandrel by application of a sufficient force applied through the pulling mandrel to cause the at least one radially inwardly directed protrusion on the collet to unseat from the corresponding at least one notch in the exterior of the pulling mandrel. The application of force to the collet is provided upon stroking of the hydraulic section of the expansion tool to pull the first expander on the distal end of the pulling mandrel against the distal end of the expandable outer clad which, in turn, bears against the ratcheting component engaged with the proximal end of the expandable outer clad to lock the ratcheting component on the ratchet rack due to the ratcheting component being forced in a proximal direction along the ratchet rack. The ratcheting component opposes movement in a proximal direction along the ratchet rack due to the unidirectional ratchet ring and, therefore, transfers the force applied by the first expander to the expandable outer clad through the ratcheting component to the ratchet rack, urging the ratchet rack in the proximal direction against the collet. The ratchet rack bears against the collet which bears against the slip cage to set the slips by urging them up and radially outward of the slip actuator. Once the slips are set, the collet is held in place and the force applied to the pulling mandrel becomes sufficient to unseat the pulling mandrel from the collet, and the pulling mandrel then continues to move in a proximal direction relative to the housing and the slips to pull the first expander through an interval of the expandable outer clad.

The drawings that are appended to this application illustrate one embodiment of the expansion tool and method of the present invention. It will be understood that other embodiments may also be within the scope of the present invention, which is limited only by the claims.

BRIEF DESCRIPTION OF THE DRAWINGS

FIG. 3, like FIG. 1, illustrates the run-in configuration of the expansion tool.

FIG. 10 corresponds to the position of the annular piston and adjacent annular stop of FIG. 9.

DETAILED DESCRIPTION

Figure 1:
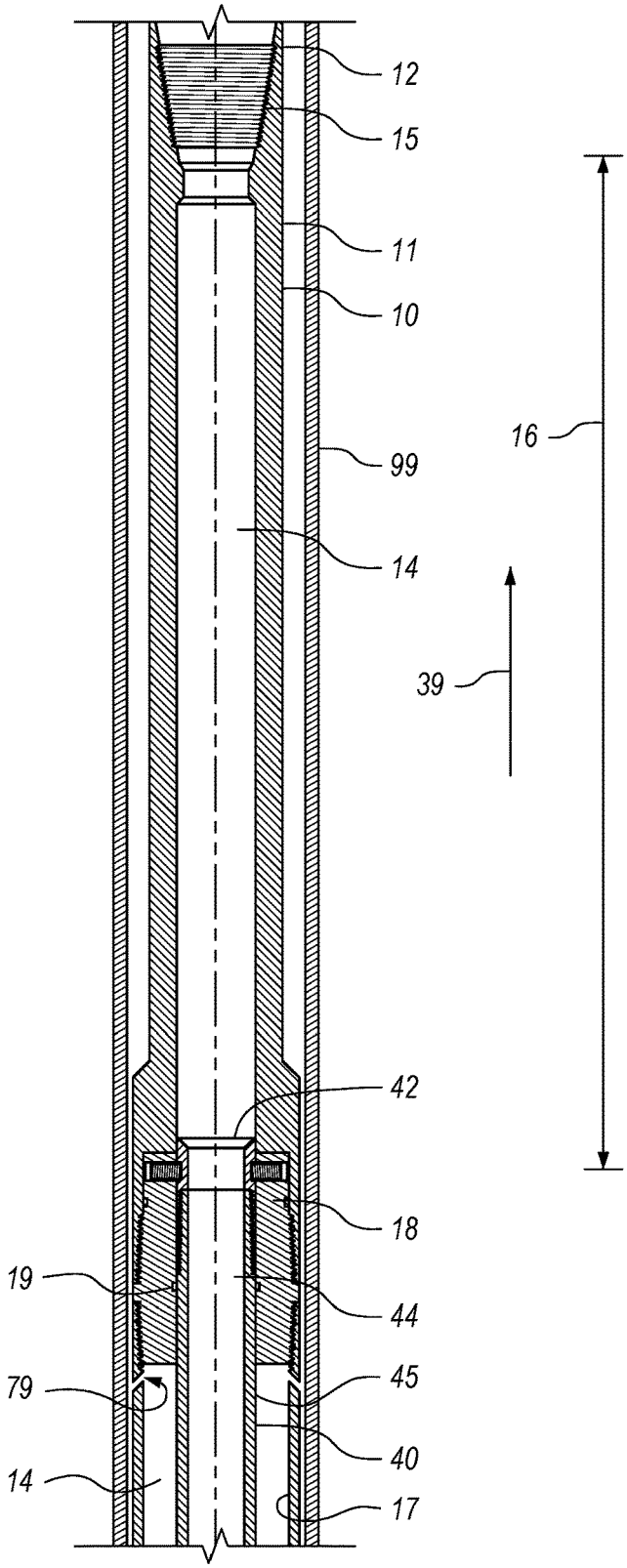
FIG. 1 is a sectional elevation view of a proximal end of an embodiment of the expansion tool of the present invention in a run-in configuration. The distal end of the tubular string used to run and position the expansion tool in the well is not shown in FIG. 1.

FIG. 1 is a sectional view of a proximal end 12 of an embodiment of the expansion tool 10 of the present invention disposed within a casing 99. FIG. 1 illustrates a threaded connector 15 that used to secure the housing 11 of the liner expansion tool 10 to a correspondingly threaded distal end of a tubular string (not shown) extended stepwise from a rig (not shown) into a casing 99 of a well. The proximal end of the tubular string is conventionally coupled to a draw works on the rig to enable positioning of the liner expansion tool 10 in the casing 99.

FIG. 1 illustrates the position of a proximal end 42 of a pulling mandrel 40 that is reciprocatably and slidably disposed within the bore 14 of the housing 11 of the expansion tool 10. In FIG. 1, the proximal end 42 of the pulling mandrel 40 is at a distance 16 from the proximal end 12 of the housing 11. FIG. 1 further illustrates a bore 44 of the pulling mandrel 40 and a seal 19 between an annular stop 18 extending radially inwardly from the bore 14 of the housing 11 and the exterior surface 41 of the pulling mandrel 40. The seal 19 prevents fluid pressure introduced into the proximal end 12 of the housing 11 from being communicated to the bore 14 of the housing 11 below the seal 19, and the seal 19 re-directs fluid pressure that is introduced through the tubular string (not shown) and into the proximal end 12 of the housing 11 into the bore 44 of the pulling mandrel 40. It will be noted that, in the embodiment of the apparatus of the present invention shown in FIG. 1, the bore 14 of the housing 11 is substantially larger below the seal 19 than it is above the seal 19. Hydraulic stroking of the pulling mandrel 40 within the bore 14 of the housing 11 from the position illustrated in FIG. 1 to the position illustrated in FIG. 2 results in movement of the pulling mandrel 40 within the bore 14 of the housing 11 in the direction of arrow 39 to the position illustrated in FIG. 2.

Figure 2:
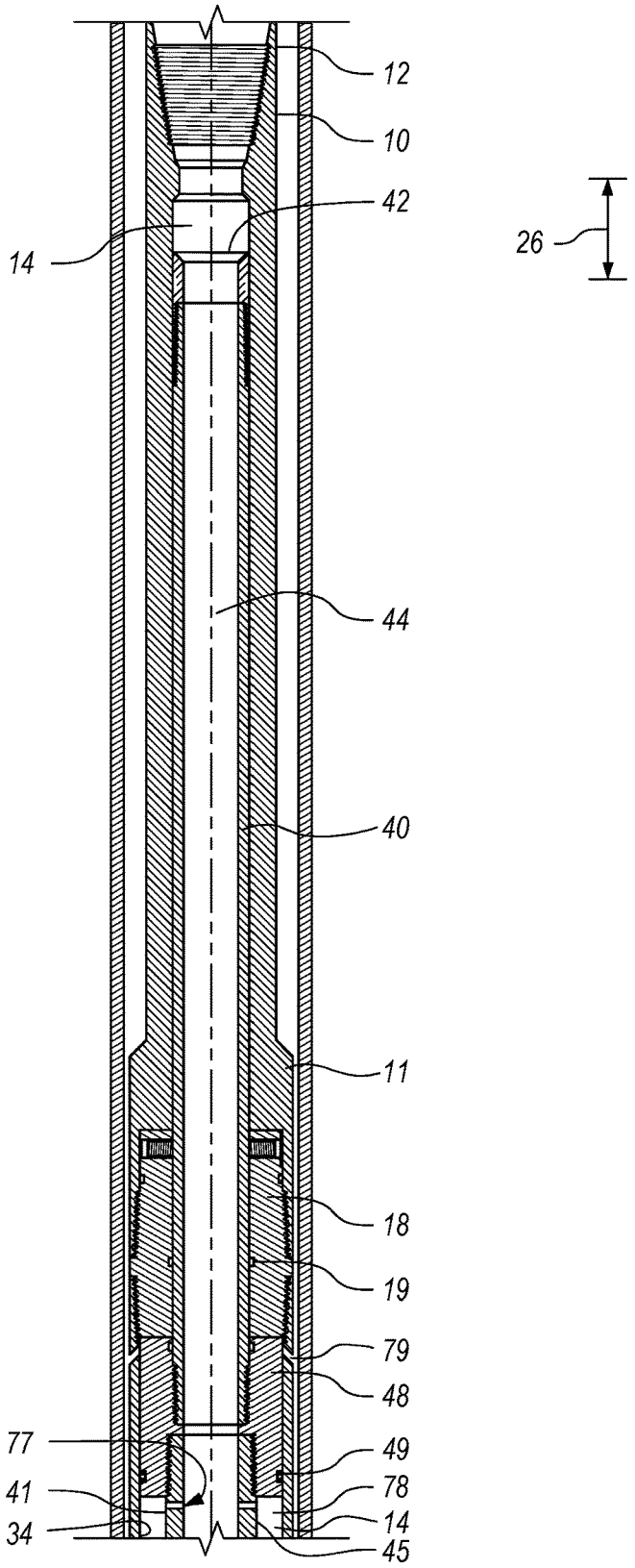
FIG. 2 is the view of FIG. 1 after the proximal end of the pulling mandrel is hydraulically displaced by an expansion stroke to a position that is closer to the proximal end of the housing of the expansion tool.

FIG. 2 is the sectional view of the proximal end of the embodiment of the expansion tool 10 of FIG. 1 after the pulling mandrel 40 has been hydraulically displaced within the bore 14 of the housing 11 towards the proximal end 12 of the housing 11 by hydraulically stroking of the expansion tool 10. FIG. 2 illustrates the upwardly repositioned proximal end 42 of the pulling mandrel 40 within the bore 14 of the housing 11 from the distance 16 from the threaded connector 15 illustrated on FIG. 1 to lesser distance 26 illustrated on FIG. 2. As will be explained in detail below, the distance of the displacement of the pulling mandrel 40 during a stroke is illustrated by the distance 16 of FIG. 1 less the distance 26 in FIG. 2, and that difference is related to the interval of an expandable outer clad 62 (not shown) that can be expanded by a single hydraulic stroke of the expansion tool 10, after which the expansion tool 10 must be re-cocked in order to subsequently further expand additional intervals of the expandable outer clad 62. It will be understood, however, that at some point during the stepwise outer clad expansion process, the remaining portion of the expandable outer clad 62, or some portions of the expandable outer clad 62, can be expanded by merely pulling the expansion tool 10 using the draw works on the rig. The inner clad 260, which is expanded after the expansion of the outer clad 62 is completed, may be expanded in its entirety by use of the draw works on the rig to pull the expansion tool 10 to draw the second expander 187 through the bore 123 of the inner clad 260, but the hydraulic section of the expansion tool 10 remains available for being set in the casing 99 and stroked to pull the second expander 187 should a tight spot be encountered, as will be discussed in more detail below.

Stroking of the expansion tool 10 from the run-in configuration or cocked configuration, illustrated in FIG. 1, to the stroked configuration or un-cocked configuration, illustrated in FIG. 2, is enabled by hydraulic pressurization of the tubular string (not shown) and the bore 44 of the pulling mandrel 40. FIG. 2 illustrates a first annular piston 48 extending radially outwardly from an exterior surface 41 of the pulling mandrel 40 to slidably and sealably engage the bore 14 of the housing 11. A seal 49 on the first annular piston 48 engages the bore 14 of the housing 11. FIG. 2 further illustrates a first annular stop 18 extending radially inwardly from the bore 14 of the housing 11 to sealably and slidably engage the exterior surface 41 of the pulling mandrel 40 at the seal 19. The first annular piston 48 on the pulling mandrel 40 appears in FIG. 2, and not in FIG. 1, because FIG. 2 illustrates the position of the pulling mandrel 40 after upward displacement of the pulling mandrel 40 in the proximal direction (in the direction of arrow 39 on FIG. 1) within the bore 14 of the housing 11 to bring the first annular piston 48 proximal to the first annular stop 18 and into the same view as the proximal end 12 of the housing 11. Fluid pressure introduced into the tubular string (not shown) and into the proximal end 12 of the housing 11 is isolated by the seal 19 on the first annular stop 18 and thereby redirected into the bore 44 of the pulling mandrel 40. The pressure is communicated from the bore 44 of the pulling mandrel 40 through aperture 77 in the pulling mandrel 40 to a first annular chamber 78 formed radially between the exterior surface 41 of the pulling mandrel 40 and the bore 14 of the housing 11 and formed axially between the first annular stop 18 of the housing 11 and a second annular stop 118 (not shown in FIG. 2—see FIG. 3) of the housing 11 that is below and spaced apart from the first annular stop 18. More specifically, it will be noted that the aperture 77 is disposed distal to the first annular piston 48 so that fluid pressure introduced into the first annular chamber 78 bears against the first annular piston 48 to displace the first annular piston 48 in the proximal direction (of arrow 39 in FIG. 1) during a hydraulic stroke of the expansion tool 10.

Figure 3:
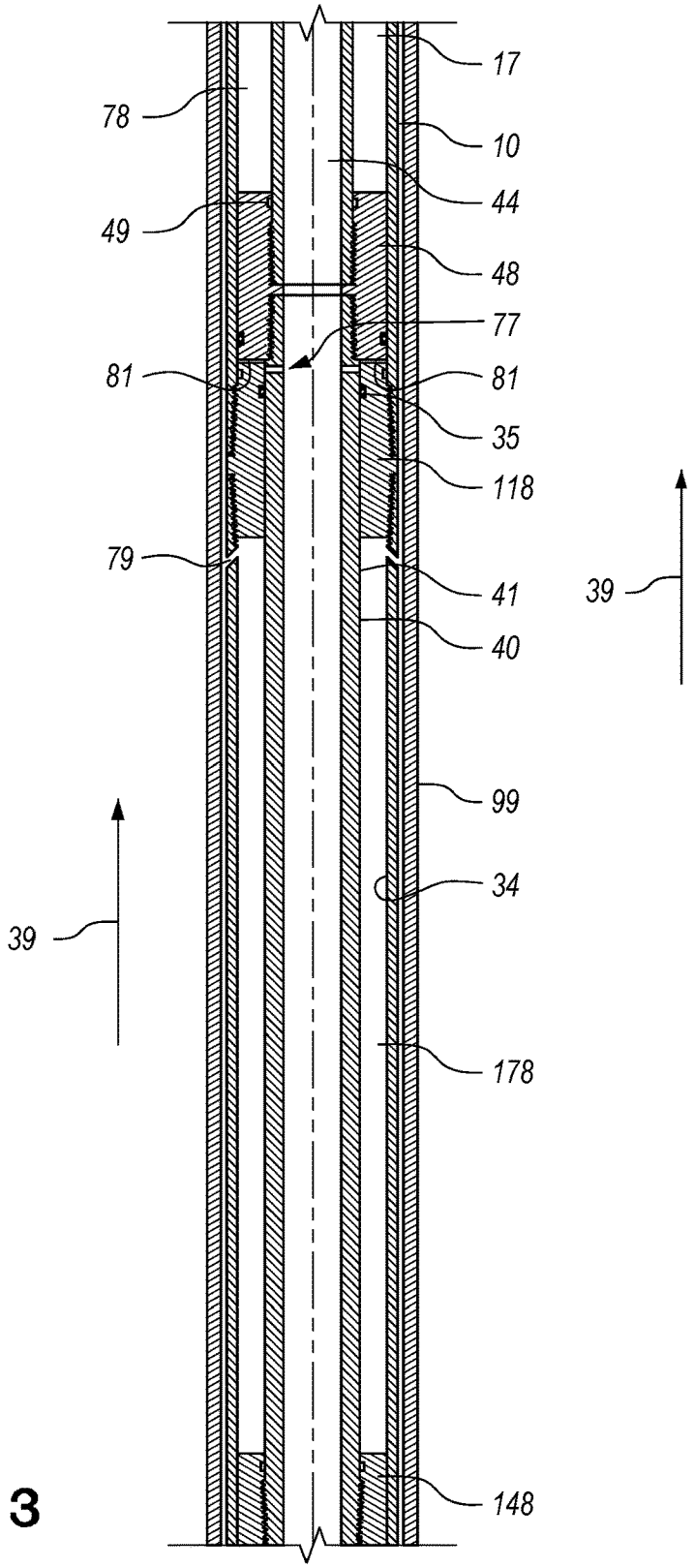
FIG. 3 is a sectional elevation view of a portion of the hydraulic section of the expansion tool of FIG. 1 illustrating an annular piston on the pulling mandrel disposed adjacent to an annular stop of the housing forming an end of an annular chamber in which an annular piston is movable.

FIG. 3 is a sectional view of a lower portion of the expansion tool 10 of FIG. 1 illustrating a first annular piston 48 on the pulling mandrel 40 adjacent and proximal to a second annular stop 118 of the housing 11. Fluid pressure introduced into the bore 44 of the pulling mandrel 40 is communicated from the bore 44 of the pulling mandrel 40 through the aperture 77 to a distal portion 81 of the annular cylinder 78, distal to the first annular piston 48 and between the first annular piston 48 and the second annular stop 118. The distal portion 81 of the annular cylinder 78 appears very small in FIG. 3 because the expansion tool 10 is in the run-in configuration or the cocked configuration, meaning that the expansion tool 10 in the configuration in FIG. 3 is cocked and ready for being hydraulically stroked. The fluid pressure introduced into the distal portion 81 of the annular cylinder 78 will displace the first annular piston 48 and the pulling mandrel 40 in an upward or proximal direction (in the direction of the arrow 39). Fluid residing in the remaining or proximal portion of the first annular cylinder 78, that is, between the first annular piston 48 and the first annular stop 18 (see FIG. 2), is displaced from the expansion tool 10 through exhaust aperture 79 (not shown in FIG. 3—see FIGS. 1 and 2) in the housing 11 as the first annular piston 48 and pulling mandrel 40 are moved within the housing 11. It will be understood that the distal end of the first annular piston 48 is exposed to the elevated fluid pressure provided through the bore 44 of the pulling mandrel 40 and through the aperture 77 in the pulling mandrel 40 during a hydraulic stroking of the expansion tool 10.

The second annular stop 118 shown in FIG. 3 forms a distal end of a first annular cylinder 78 in which the annular piston 48 on the pulling mandrel 40 is movable. The portion of the expansion tool 10 illustrated in FIG. 3 is distal to the portion of the expansion tool 10 illustrated in FIGS. 1 and 2. FIG. 3 illustrates the first annular cylinder 78 axially intermediate a first annular stop 18 (not shown in FIG. 3—see FIGS. 1 and 2) extending radially inwardly from the interior surface 34 of the housing 11 and a second annular stop 118 also extending radially inwardly from the interior surface 34 of the housing 11. The first annular stop 18 of FIG. 1 and the second annular stop 118 of FIG. 2 are spaced apart one from the other within the housing 11 to define the first annular cylinder 78 axially therebetween, and both of the first annular stop 18 and the second annular stop 118 sealably engage the exterior surface 41 of the pulling mandrel 40 at seals 19 and 35, respectively. A first annular piston 48 moves within the first annular cylinder 78 and is depicted in FIG. 3 immediately adjacent to the second annular stop 118 of the housing 11, thereby indicating that the expansion tool 10 is in the cocked configuration in FIG. 3. The seal 35 on the second annular stop 118 and the seal 19 on the first annular stop 18 (see FIG. 1) engage the exterior surface 41 of the pulling mandrel 40 to isolate the first annular cylinder 78 so that fluid pressure introduced into the distal portion 81 of the first annular cylinder 78 through the aperture 77 will exert a displacing force against the first annular piston 48 to move it within the first annular cylinder 78 as fluid is displaced from the first annular cylinder 78 through exhaust apertures 79 shown on FIGS. 1-3.

FIG. 3 illustrates the aperture 77 in the pulling mandrel 40 positioned to axially coincide with the distal portion 81 of the first annular cylinder 78 shown in FIG. 3 intermediate the first annular piston 48 of the pulling mandrel 40 and the second annular stop 118 of the housing 11. Pressurization of fluid within the tubular string (not shown in FIG. 3) is communicated through the proximal end 12 of the housing 11 (see FIG. 1), into the bore 44 of the pulling mandrel 40 and through the aperture 77 in the pulling mandrel 40 to the portion of the annular chamber 78 at the distal end 81 to hydraulically urge the first annular piston 48 and the pulling mandrel 40 to move in the proximal direction as indicated by arrow 39. It will be understood that hydraulic displacement of the first annular piston 48 of FIG. 3 in a proximal direction and away from the second annular stop 118 of the housing 11 and towards the first annular stop 18 of the housing 11 (shown on FIG. 1) to increase the distal portion 81 will move the pulling mandrel 40 to the "stroked" or un-cocked position corresponding to FIG. 2.

FIG. 3 also illustrates a second annular piston 148 on the pulling mandrel 40 that is spaced apart on the pulling mandrel 40 from the first annular piston 48. The second annular piston 148 is movable within a second annular chamber 178 formed axially between the second annular stop 118 of the housing 11 and a third annular piston 218 (not shown in FIG. 3) and radially between the exterior surface 41 of the pulling mandrel 40 and the interior surface 34 of the housing 11. The alternating arrangement of annular stops and annular pistons illustrated in FIGS. 1 and 3 can be extended to provide an aligned series of stacked annular cylinders, each reciprocatably receiving annular pistons to thereby multiply the amount of force that can be hydraulically applied to the pulling mandrel 40 to displace the pulling mandrel 40 within the bore 14 of the housing 11 during a stroke of the expansion tool 10. As stated above, and reiterated below, the hydraulic section of the expansion tool 10 can be used to hydraulically displace the pulling mandrel 40, the first expander 87 coupled thereto, the pulling mandrel extension 140 and the second expander 187 coupled thereto.

Figure 4:
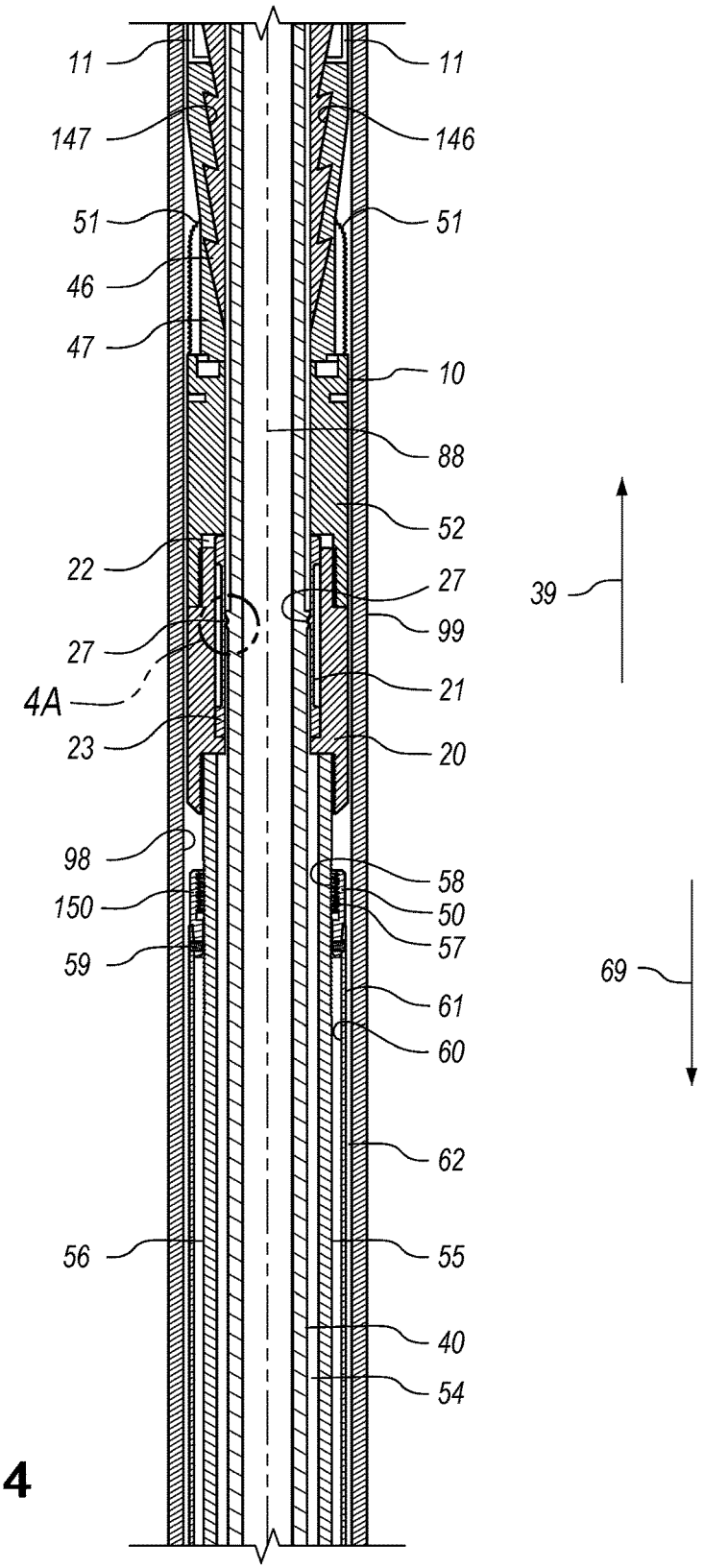
FIG. 4 is a sectional view of a gripping portion of an embodiment of the expansion tool that includes a plurality of slip actuators coupled to the housing and a plurality of slips coupled to a ratchet retainer and displaced by initial movement of the pulling mandrel relative to the housing at the onset of an expansion stroke. A reaction assembly of the expansion tool (including a rack retainer, a ratchet rack and a ratcheting component) is illustrated as being disposed below the slips to react against the outer clad at the onset of expansion of the outer clad.
Figure 4A:
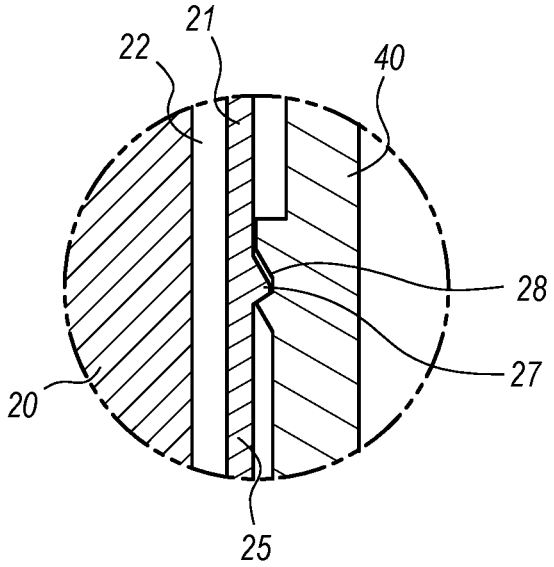
FIG. 4A is an enlarged view of a radially inwardly disposed protrusion of the collet at the location of interaction with a radially outwardly disposed notch of the pulling mandrel.
Figure 5:
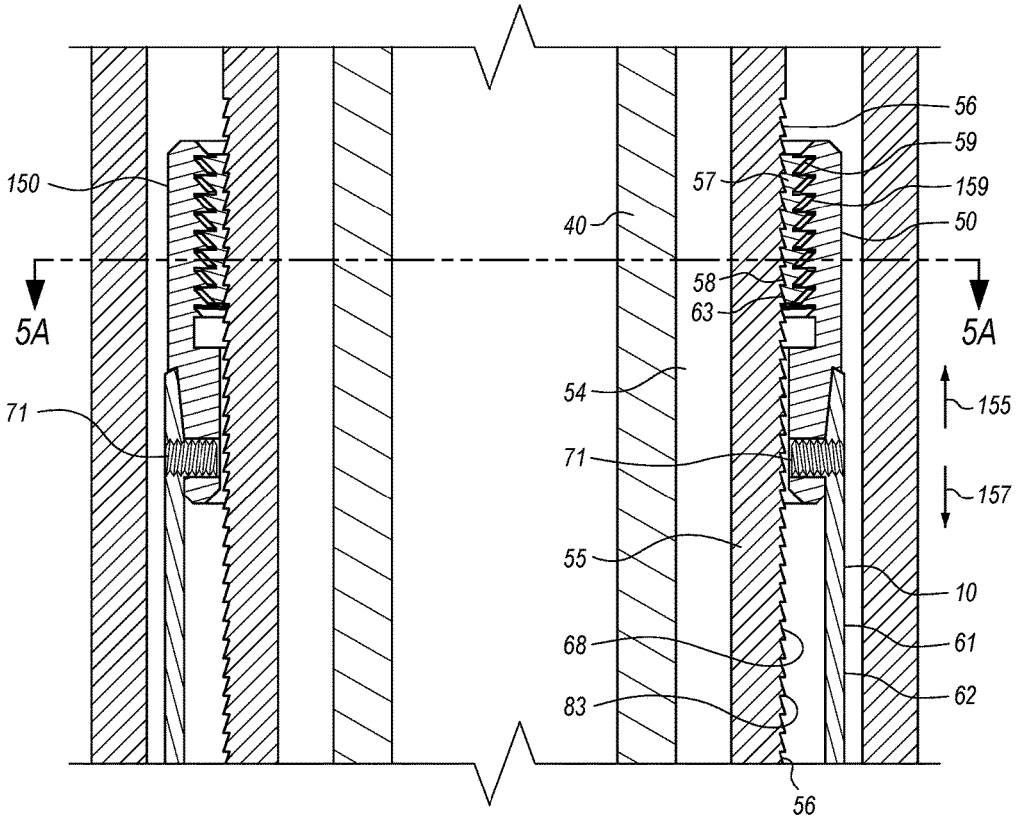
FIG. 5 is an enlarged view of a portion of a ratcheting component threadedly engaged with the exterior surface of a ratchet rack to enable relative movement of the ratchet rack only in a proximal direction relative to the ratcheting component.

FIG. 4 is a sectional view of a portion of the embodiment of the expansion tool 10 of FIGS. 1-3 that is below the hydraulic section of the expansion tool 10 illustrated in FIGS. 1-3. The portion of the expansion tool 10 illustrated in FIG. 4 includes a plurality of slips 47 linked to a rack retainer 52 that is secured to a collet cage 20 that, in turn, surrounds a collet 21. Turning to FIG. 4A, the collet 21 is releasably coupled to the pulling mandrel 40 using one or more radially outwardly disposed notches 28 on the pulling mandrel 40 that releasably receive one or more radially inwardly protruding ridges 27 on the collet 21. The collet cage 20 includes an interior channel 22 that surrounds the collet 21 and allows a limited amount of movement of the collet 21 within the collet cage 20. Returning to FIG. 4, the collet cage 20 is coupled to the ratchet rack 55. The ratchet rack 55 is a tubular member having a bore 54 and a buttress-threaded exterior 56 to cooperate with a ratcheting component 150 that is movable in the direction of arrow 69 along the ratchet rack 55. It will be understood that the ratcheting component 150 may move in the direction of arrow 69 along a stationary ratchet rack 55 or the ratchet rack 55 is movable in the direction of arrow 39 within a stationary ratcheting component 150, which is the same relative direction of movement of one component relative to the other. This unidirectional movement is permitted by the buttress-threaded exterior 56 of the ratchet rack 55 and the corresponding buttress-threaded interior bore of the ratchet ring 57. The ratcheting component 150 includes the ratchet ring 57 captured within a shaped chamber 159 (see FIGS. 5 and 5A) of a ring housing 50. The ratchet ring 57 is illustrated in FIG. 5 in the collapsed or contracted position to lock the ratcheting component 150 in position relative to the ratchet rack 55 and to thereby prevent movement of the proximal end 61 of the expandable outer clad 62 relative to the ratchet rack 55. It will be understood that this condition may leave a small amount of space within the chamber 159 radially outwardly of the ratchet ring 57. The ratchet ring 57 may include radially outwardly extending exterior threads 59 for engaging the correspondingly shaped chamber 159 of the ring housing 50 upon expansion of the ratchet ring 57. The ratchet ring 57 of FIG. 5 further includes radially inwardly extending interior buttress threads 58 that cooperate with correspondingly shaped buttress threads along the threaded exterior 56 of the ratchet rack 55. In FIG. 5, these interior buttress threads 58 of the ratchet ring 57 are shown engaged with the correspondingly shaped threaded exterior 56 of the ratchet rack 55 of the expansion tool 10.

Returning to FIG. 4, the reaction assembly of the expansion tool 10 of the embodiment of the present invention illustrated in the appended drawings includes the rack retainer 52, the collet cage 20, the collet 21, the ratchet rack 55 and the ratcheting component 150 which includes a ratchet ring 57 and a ratchet housing 50. The ratchet ring 57 includes a longitudinal slot to allow expansion and contraction of the ratchet ring 57 within the ratchet housing 50 as one of the ratcheting component 150 and the ratchet rack 50 moves relative to the other of the ratcheting component 150 and the ratchet rack 50. Turning again to FIG. 5, the ratchet ring 57 is specially threaded to enable uni-directional movement along the ratchet rack 55 relative to the ratcheting component 150 by circumferentially expanding, along the slot of the ratchet ring 57, within the chamber 159 of the ring housing 50 to a size large enough to allow the radially inwardly disposed buttress threads 58 of the ratchet ring 57 to index or to skip over the corresponding radially outwardly extending buttress threads 56 on the exterior of the ratchet rack 55 for relative movement of the ratchet ring 57 and ring housing 50 in the direction of arrow 157 or, conversely, for relative movement of the ratchet rack 55 relative to the ratchet ring 57, and relative to the ring housing 50 in which the ratchet ring 57 is expandably captured, in the direction of arrow 155. It will be understood that each buttress thread of the various buttress-threaded surfaces each include a ramped side and a steep side, and that the inwardly extending buttress-threads 58 on the ratchet ring 57 and the outwardly extending buttress-threads on the ratchet rack 55, respectively, are together arranged for movement in the direction of the ramped side of the buttress threads. The reaction assembly is adapted to accommodate both axial outer clad 62 shrinkage due to radial expansion and re-cocking of the expansion tool 10 for repeated and sequential strokes, as will be discussed below.

Figure 5A:
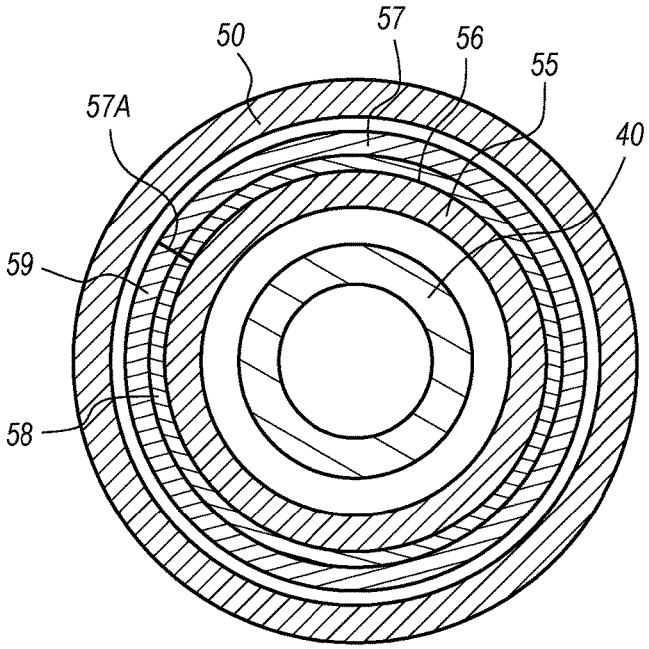
FIG. 5A is a sectional view of the ratcheting component of the expansion tool illustrated in FIG. 5 with the ratchet ring in the radially inwardly collapsed or contracted mode to prevent movement of the ratchet rack in a distal direction relative to the ratcheting component.

FIG. 5A is a sectioned view of the portion of the expansion tool 10 illustrated in FIG. 5 with the section line taken through the ratchet ring 57 and the ring housing 50 in which the ratchet ring 57 is expandably captured. FIG. 5A shows the pulling mandrel 40, which is movably received within the bore 54 of the ratchet rack 55, which is movably received within the ratchet ring 57 which is expandably captured within the ring housing 50. The sectional view of FIG. 5A illustrates the contracted or locked position of the ratchet ring 57 and only a small amount of the inwardly extending buttress threads 58 of the ratchet ring 57 can be seen in FIG. 5A because they are locked and engaged with the corresponding buttress threads 56 of the ratchet rack 55. The outwardly extending threads 59 of the ratchet ring 57 are visible in FIG. 5A between the ratchet ring 57 and the ring housing 50. This position corresponds to the condition of the reaction assembly that resists movement of the ratchet ring 57 and ring housing 50 along the ratchet rack 55, such as when the expandable outer clad 62 is first being expanded within the well casing 99 and requires that the reaction assembly hold it in position within the well casing 99. It will be noted that in FIG. 5A, which corresponds to the contracted position of the ratchet ring 57, there is either no gap or a small gap 57A formed at the slot of the ratchet ring 57 which is in its circumferentially contracted configuration. It will be further noted that the expandable outer clad 62 is not in the sectioned view of FIG. 5A, which is above the expandable outer clad 62.

Figure 5B:
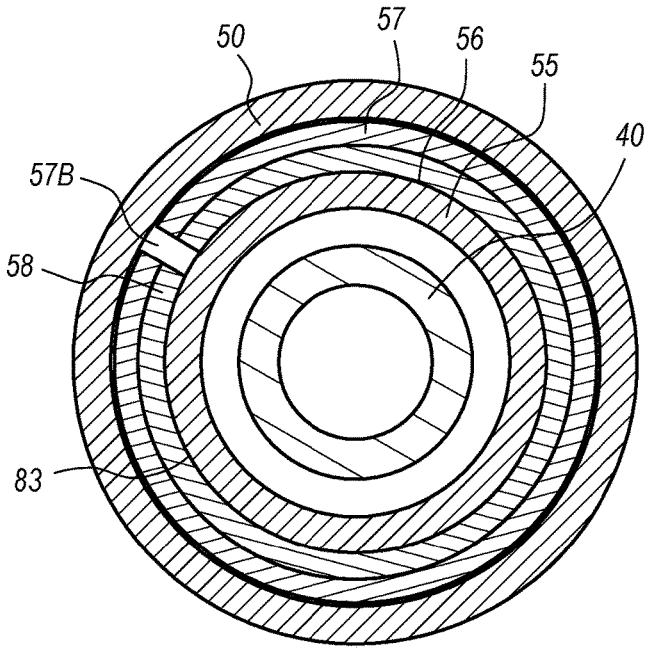
FIG. 5B is the sectional view of the portion of the expansion tool of FIG. 5A with the ratchet ring in the circumferentially expanded mode to permit movement of the ratchet rack in a proximal direction relative the ratcheting component.

FIG. 5B is another sectioned view of the portion of the expansion tool 10 illustrated in FIG. 5 with the section line taken through the ratchet ring 57 and the ring housing 50 in which it is expandably captured. FIG. 5B also shows the pulling mandrel 40, the ratchet rack 55, the ratchet ring 57 and the ring housing 50, but the sectional view of FIG. 5B illustrates the expanded position of the ratchet ring 57. It should be noted that the inwardly extending buttress threads 58 of the ratchet ring 57 can be seen in FIG. 5B because they are expanded and disengaged from the buttress threads 56 of the ratchet rack 55. The outwardly extending threads 59 of the ratchet ring 57 are not visible in FIG. 5B between the ratchet ring 57 and the ring housing 50 because they are recessed within the shaped chamber 159 of the ring housing 50. This position corresponds to the condition of the reaction assembly that permits movement of the ratchet ring 57 and ring housing 50 along the ratchet rack 55, such as when the expandable outer clad 62 axially contracts while being expanded within the well casing 99. It will be noted that in FIG. 5B, which corresponds to the expanded position of the ratchet ring 57, there is a larger gap 57B formed in the ratchet ring 57 which is in its circumferentially expanded configuration.

Returning to FIG. 5, a proximal end 61 of an expandable outer clad 62 is received concentrically onto the elongate ratchet rack 55 prior to connection of the expander 87 (see FIG. 7) to axially capture the expandable outer clad 62 between the expander 87 and the ratcheting component 150 and to concentrically surround the ratchet rack 55 with the expandable outer clad 62. The expandable outer clad 62 is also axially captured intermediate the ring housing 50 of the ratcheting component 150, which is engaged with the proximal end 61 of the expandable outer clad 62, and the expander 87 (not shown in FIG. 5—see FIGS. 7 and 8) connected to a distal end of the pulling mandrel 40 that is reciprocatably received through the bore 54 of the ratchet rack 55. The proximal end 61 of the expandable outer clad 62 is illustrated in FIG. 5 as being disposed around at least a portion of the ring housing 50 and secured to the ring housing 50 by threaded fasteners 71. The expandable outer clad 62 is illustrated in FIG. 5 and in FIGS. 7 and 8 in position for being radially outwardly expanded by stroking of the pulling mandrel 40 to pull the first expander 87 to expand an interval the expandable outer clad 62 and to engage the expanded interval of the outer clad 62 with the interior wall 98 of the targeted interval of the well casing 99.

Figure 6:
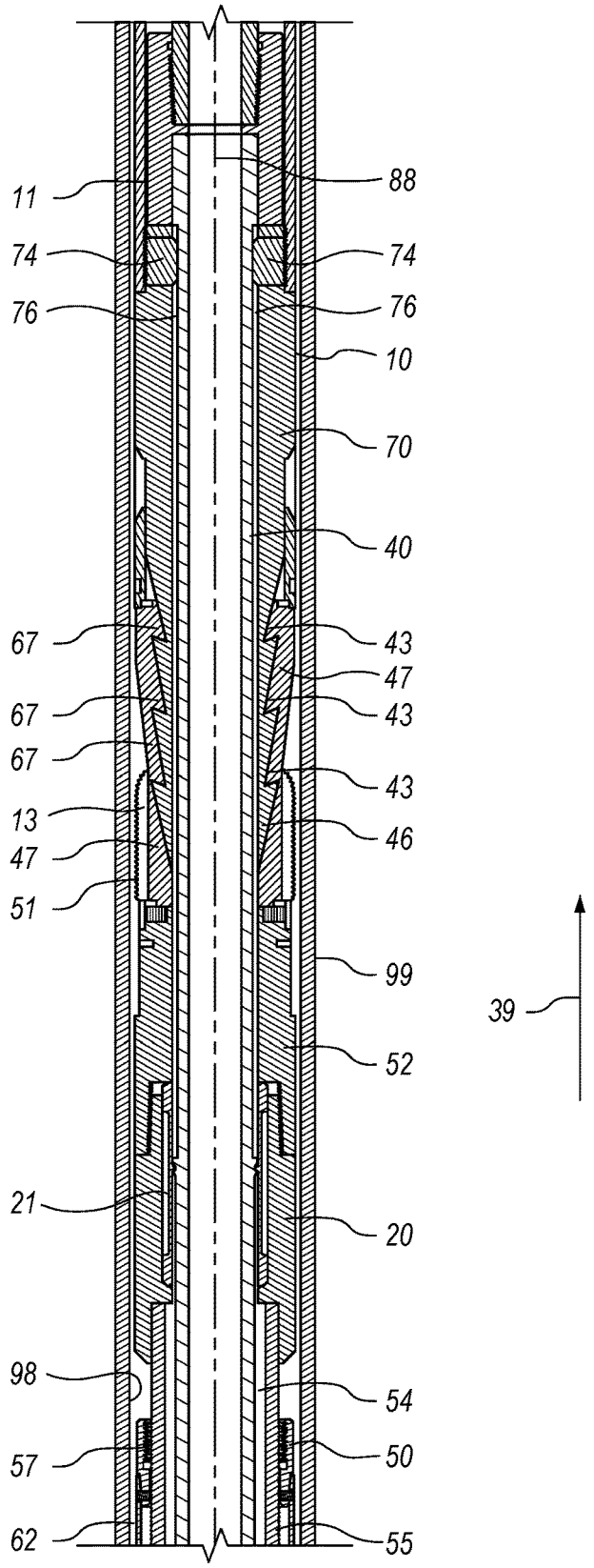
FIG. 6 is a sectional elevation view of a portion of the embodiment of the expansion tool of the present invention including slip actuators positioned for being moved under or radially within the adjacent slips to secure the housing within the casing in which the expandable outer clad is to be expanded.

FIG. 6 illustrates how the expansion tool 10 of the present invention is securable in the well casing 99 in which the expandable outer clad 62 is to be expanded and installed, as opposed to being securable in the expandable outer clad 62 itself, as are some other downhole casing liner expansion tools. The slips 47 of the expansion tool 10 are radially outwardly deployable to engage the interior wall 98 of the well casing 99 by initial movement of the pulling mandrel 40 and the first expander 87 attached thereto in the direction of the arrow 39 relative to the housing 11 of the expansion tool 10. Movement of the pulling mandrel 40 (and the first expander 87 connected thereto and shown in FIGS. 7 and 8) in the direction of the arrow 39 places the expandable outer clad 62 in axial compression and transfers the axial component of the force applied by the first expander 87 to the distal end 64 (not shown in FIG. 6—see FIG. 8) of the expandable outer clad 62 to the ring housing 50 and to the ratchet ring 57 within the ring housing 50 engaged with the proximal end 61 of the expandable outer clad 62. The ratchet ring 57 transfers the axial component of the force applied by the first expander 87 through the expandable outer clad 62 to the ring housing 50 that is uni-directionally disposed on the ratchet rack 55. The ring housing 50 transfers the force, through the ratchet ring 57, to the ratchet rack 55 and to the collet cage 20 that surrounds the collet 21. The collet cage 20 transfers the force to the rack retainer 52 that is connected through the collet cage 20 to the ratchet rack 55, and the rack retainer 52 transfers the force to the slips 47 and urges the slips 47 in a proximal direction relative to the slip actuator 46. The slips 47 include sloped interior portions 67 that slide against and cooperate with similarly sloped exterior portions 43 of the slip actuator 46. As the slips 47 are displaced upwardly in the direction of arrow 39 relative to the slip actuators 46 by the force applied to the slips 47 by the rack retainer 52 during an expansion stroke as described above, the slips 47 are radially outwardly deployed away from the axis 88 of the expansion tool 10 to engage and grip the interior wall 98 of the casing 99. It should be noted that the slips 47 are radially outwardly deployed by a small amount of axial movement of the slips 47 relative to the cooperating slip actuators 46 to engage and grip the casing 99. It will be understood that the slips 47 may be disposed within a slip cage portion or extension of the tubular housing 11 having openings or "windows" adjacent to the slips 47 to permit the slips 47 to grippingly engage the interior wall 98 of the casing 99 upon deployment to secure the expansion tool 10 in position within the casing 99. In one embodiment, the slips 47 may be biased towards the retracted configuration by springs 51.

FIG. 5 is an enlarged view of the specially threaded interface between the ratchet rack 55 and the ratchet ring 57 of the expansion tool 10. The ratchet ring 57 includes a threaded interior bore 58 having threads such as, for example, buttress threads. Optionally, the ratchet ring 57 may also include exterior surface features such as, for example, exterior threads 59 for grippingly engaging the interior bore 53 of the proximal end 61 of the expandable outer clad 62. The ratchet ring 57 illustrated in FIG. 5 is secured to the proximal end 61 of the expandable outer clad 62 using threaded fasteners 71. The ratchet rack 55, on which the ratchet ring 57 is uni-directionally movable, also includes a bore 54 through which the pulling mandrel 40 is received. It will be understood that only small portions of the pulling mandrel 40, the ratchet rack 55 and the ratchet ring 57 are shown in the enlarged view of FIG. 5. The threaded exterior surface 56 of the ratchet rack 55 also includes buttress threads 56 such as, for example, buttress threads, that cooperate with the buttress threads on the threaded interior bore 58 of the ratchet ring 57 to provide for movement of the ratchet ring 57 only in the distal direction along the ratchet rack 55, as indicated by arrow 157 in FIG. 5 or, stated another way, to provide for movement of the ratchet rack 55 in a proximal direction relative to the ratchet ring 57, as indicated by arrow 155. The threads 58 of the ratchet ring 57 and the engaging threads 56 of the ratchet rack 55 cooperate to prevent movement of the ratchet ring 57 in the proximal direction along the ratchet rack 55. It will be understood that the axially compressing force applied by the first expander 87 (see FIG. 7) to the distal end 64 of the outer clad 62 is transferred to the retainer ring 57 urging it to move along the ratchet rack 55, and that the threading of the ratchet rack 55 and ratchet ring 57 (see FIG. 5) prevent movement of the ratchet ring 57 in response to the force applied by the first expander 87 to the outer clad 62. This interaction between the ratchet rack 55 and the ratchet ring 57 enables the transfer of the force to the rack retainer 52 and to the slips 47 at the onset of an expansion stroke.

FIG. 5A shows an embodiment of the ratchet ring 57 for use in connection with the expansion tool 10 of the present invention that includes a slot 57A to allow for circumferential elastic expansion and contraction (collapse) of the ratchet ring 57 as it and the ring housing 50 ratchets along the exterior surface 56 of the ratchet rack 55 (in one direction only due to the buttress threads). It will be understood that the ramping side 63 of the buttress threads 58 (see FIG. 5) within the bore of the ratchet ring 57 will slide along the ramping side 68 of the exterior buttress threads 56 on the ratchet rack 55 to impart an expanding force to the ratchet ring 57 that will cause the slot 57A (see FIG. 5A) to open and expand the ratchet ring 57 enough to allow movement of the ratchet ring 57 in a distal direction (in the direction of arrow 157 on FIG. 5) relative to the ratchet rack 55. The slotted ratchet ring 57 of FIG. 5A will elastically return to a contracted configuration after the peaks 83 of the threads 56 and 58 of the ratchet rack 55 and ratchet ring 57 each pass the other and return to the collapsed configuration shown in FIG. 5. FIG. 5B shows the peaks 83 of the threads 56 of the ratchet rack 55 and the threads 58 of the ratchet ring 57 engaged just before the ratchet ring 57 collapses or retracts back to the configuration shown in FIG. 5A. It will be noted that in FIG. 5B the slot 57B is at its largest opening.

Alternately, in other embodiments of the expansion tool of the present invention, the ratcheting function of the ratchet ring 57, as it moves in one (the distal) direction only, can be provided by a conventional spring-biased dog provided on the ratchet ring 57 in lieu of the slot 57A. The spring-biased dog engages and rides along the thread profile 56 of the ratchet rack 55 with the spring biasing the dog to remain engaged with the threads on the ratchet rack 55. Each time a force is applied to move the ratchet ring 57 in the distal direction, the dog will be displaced radially outwardly against the spring element and away from the ratchet rack 55 as the dog clears a thread peak 83. After the dog clears the thread peak 83, the biasing of the spring element restores the dog into a valley between two adjacent thread peaks to re-engage the dog with the steep side of the thread and to prevent movement of the ratchet ring 57 in the proximal direction. It will be understood that a spring-biased dog is the same apparatus used in many conventional ratcheting apparatuses such as, for example, a ratchet tool for use with sockets and a bumper jack used to lift an automotive vehicle. It will be understood that a large variety of elastically deformable components could be included within a ratchet ring 57 to provide the elastic restoring function of the slotted ratchet ring 57 or the spring-biased ratchet ring described above.

FIG. 6 illustrates the positions of the slips 47, the slip actuator 46, the rack retainer 52, the ratchet ring 57, the ring housing 50 and the ratchet rack 55 on which the ratchet ring 57 is received with the expansion tool 10 in the run-in configuration. It can be seen in FIG. 6 that the pulling mandrel 40 is slidably received through the bore 54 of the ratchet rack 55 and through the slip actuator 46. The slip actuator 46 includes a plurality of radially outwardly extending lobes 43 that axially and slidably engage and radially outwardly displace a corresponding plurality of lobes 67 of the slips 47 when the slips 47 are displaced, relative to the slip actuator 46, by the collet 21, collet cage 20 and the rack retainer 52 engaged thereby. Each of the slips 47 are radially captured between the slip actuator 46 and a retainer spring 51, and each slip 47 is disposed adjacent a window 13 within the housing 11 through which the slip 47 can engage the interior wall 98 of the casing 99. The portion of the housing 11 adjacent to the windows 13 and adjacent to the slips 47 may be referred to as a cage portion of the housing 11 because the windows 13 give that portion a cage-like appearance. The application of force by the first expander 87 (not shown in FIG. 6—see FIG. 7) to the outer clad 62, transferred through the ring housing 50, the ratchet ring 57, the ratchet rack 55 and the rack retainer 52 to the slips 47, displaces the slips 47 axially and in the proximal direction of the arrow 39, onto the slip actuator 46, and radially outwardly against the spring 51 to engage and grip the casing 99. Once the slips 47 engage and grip the casing 99, all further hydraulic displacement of the pulling mandrel 40 relative to the housing 11 results in expansion of a portion of the expandable outer clad 62. The collet 21 and collet cage 20 cooperate with the pulling mandrel 40 (see FIG. 4A) to set the slips 47 to grip the casing 99 prior to the pulling mandrel 40 disengaging the collet 21.

Figure 7:
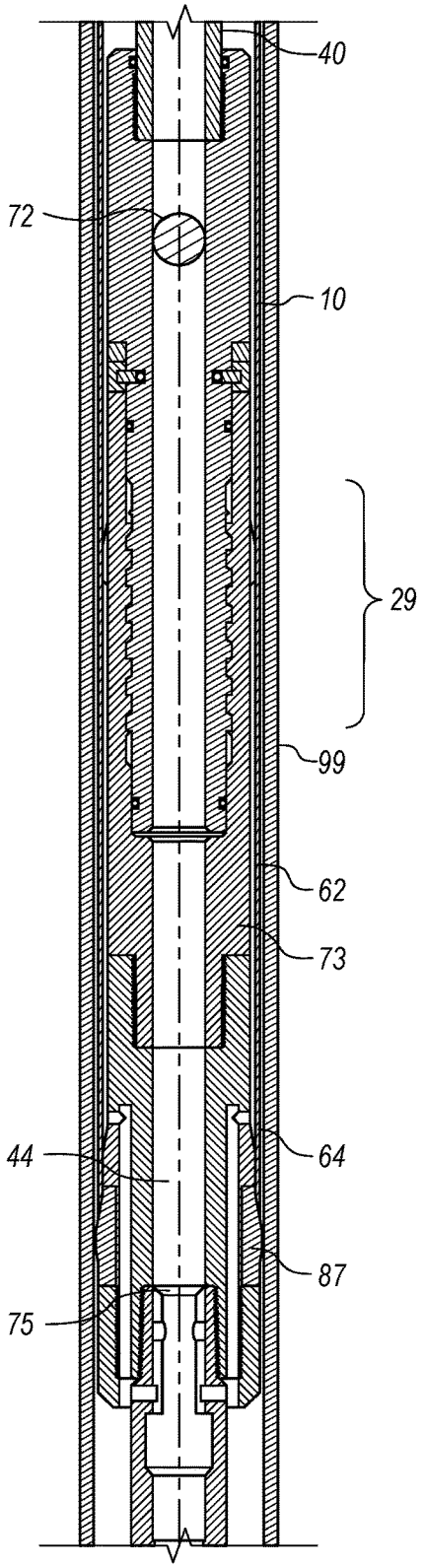
FIG. 7 is a sectional elevation view of the distal end of an embodiment of an expansion tool of the present invention illustrating the distal portion of the expandable outer clad, a ball seat within the bore of the pulling mandrel, the first expander coupled to the pulling mandrel. The bore of the pulling mandrel can be isolated for pressurization using a ball to engage the ball seat.

FIG. 7 is a sectional view of an intermediate portion 73 of the expansion tool 10 including the first expander 87 and a ball seat 75 within the bore 44 of the pulling mandrel 40. The ball seat 75 is sized to receive a ball 72 (shown in FIG. 7 as being en route to the ball seat 75) and to thereby isolate the bore 44 of the pulling mandrel 40. The ball 72 and ball seat 75 enable fluid pressure within the bore 44 to increase to a pressure sufficient to stroke the annular pistons 48 and 148 (not shown in FIG. 7—see FIGS. 2 and 3) within the annular cylinders 78 and 178 of the hydraulic section of the expansion tool 10. The ball 72 is introduced into the tubular string (not shown) at the rig, and pumped through the bore 44 of the pulling mandrel 40 and displaced to the intermediate portion 73 of the expansion tool 10 to sealably engage the ball seat 75. FIG. 7 further illustrates an optional safety joint 29 that allows the expansion tool 10 to be rotated free of the first expander 87 and ball seat 75 in the event of the expansion tool 10 becoming stuck in the casing 99. The safety joint 29 can be rotated free of the expander 87 and ball seat 75 because the keys 74 (see FIG. 6) slidably engage the grooves 76 in the pulling mandrel 40 to rotatably secure the pulling mandrel to the housing 11 while allowing axial movement of the pulling mandrel 40 relative to the keys 74 and the housing 11. This arrangement enables torque applied to the proximal end 12 of the housing 11 to be transferred through the keys 74 and grooves 76 to the safety joint 29.

Figure 8:
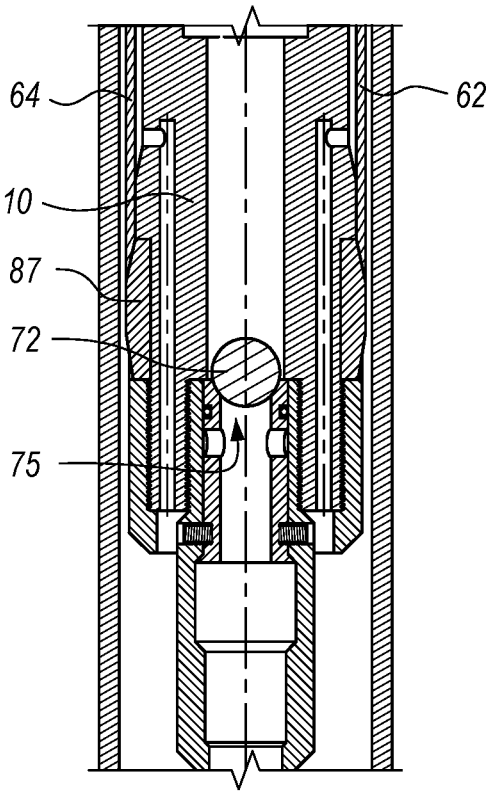
FIG. 8 is the lower portion of the view of FIG. 7 illustrating a ball being received in the ball seat to isolate the bore of the pulling mandrel to enable the expansion tool to be hydraulically stroked, causing the first expander to enter and expand the bore of the expandable outer clad.

FIG. 8 is the lower portion of FIG. 7 illustrating the position of the ball 72 after it has been sealably received onto the ball seat 75 to isolate the bore 44 of the pulling mandrel 40 (see FIG. 7) and to enable the expansion tool 10 to hydraulically stroke the first expander 87 to enter the distal end 64 of the expandable outer clad 62 and to expand the expandable outer clad 62. As the pumping of fluid into the bore 44 of the pulling mandrel 40 continues, the pressure within the bore 44 of the pulling mandrel 40 increases and displaces the annular pistons 48 and 148 and the pulling mandrel 40 to which these annular pistons 48 and 148 are secured in a proximal direction (in the direction of arrow 39 in FIGS. 1, 3 and 4) within the bore 14 of the housing 11. This relative movement causes the slips 47 to be displaced radially outwardly relative to the slip actuators 46 (see FIG. 6) to grip the casing 99 prior to disengagement of the collet 21 from the pulling mandrel 40 (see FIG. 4A) and expansion of the expandable outer clad 62.

Figure 9:
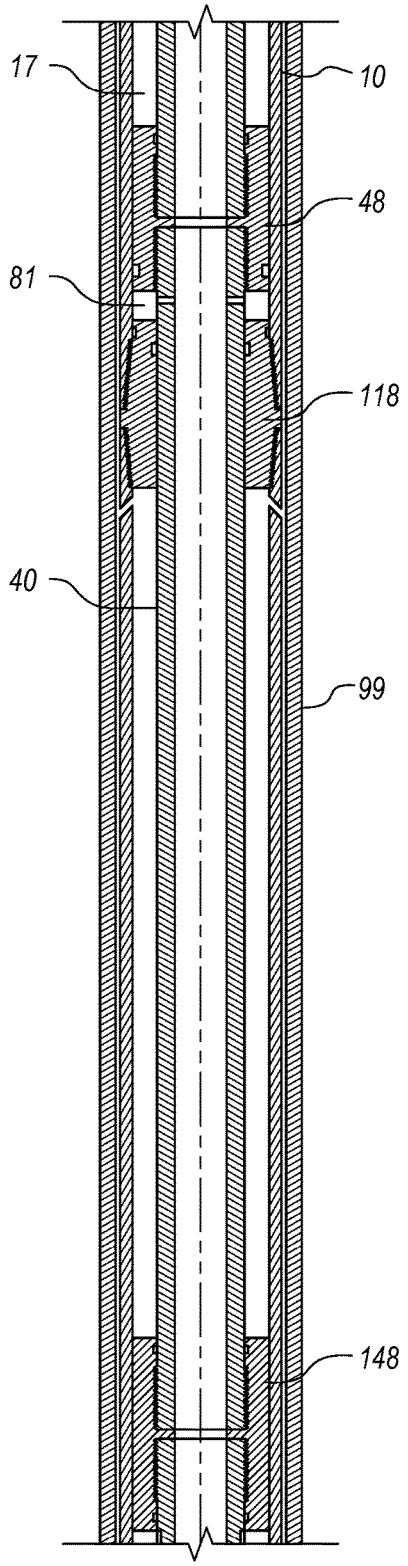
FIG. 9 is a sectional elevation view of a portion of the hydraulic section of the expansion tool of the present invention illustrating the initial separation of an annular piston on the pulling mandrel from an adjacent annular stop of the housing that occurs at the onset of a hydraulic stroke the expansion tool.

FIG. 9 is a sectional elevation view of a portion of the hydraulic section of the expansion tool 10 of the present invention illustrating a small amount of initial separation between the first annular piston 48 of the pulling mandrel 40 from a second annular stop 118 of the housing 11. FIG. 9 may be compared to FIG. 3, which reflects the condition of the expansion tool 10 prior to pressurization of the bore 44 of the pulling mandrel 40. The small amount of separation illustrated in FIG. 9 occurs after the ball 72 sealably engages and seats in the ball seat 75 of the pulling mandrel 40 and fluid within the bore 44 of the pulling mandrel 40 is pressurized to stroke the expansion tool 10, and this configuration indicates the initial portion of the stroke of the hydraulic section of the expansion tool 10. The initial separation illustrated in FIG. 9 may be correlated to the setting of the slips 47, illustrated in FIG. 10, that occurs at the onset of the stroking of the hydraulic section of the liner expansion tool 10 to secure the housing 11 of the expansion tool 10 in place within the casing 99. The small amount of separation between the first annular piston 48 and the second annular stop 118 indicates the condition of the expansion tool 10 at the time the slips 47 become engaged to grip the casing 99. Continued pressurization of the fluid in the bore 44 of the pulling mandrel 40 after the separation indicated by FIG. 9 causes further movement of the first annular piston 48 within the first annular cylinder 17 (see also FIG. 3) of the housing 11 to draw the first expander 87 into the distal end 64 of the expandable liner 62 (see FIG. 8), thereby radially expanding the expandable outer clad 62 as the first expander 87 moves through the expandable outer clad 62. After the outer clad 62 is expanded, the inner clad 260 is then expanded as the second expander 187 moves through the inner clad 260, as discussed further below in connection with FIGS. 12-15.

Figure 10:
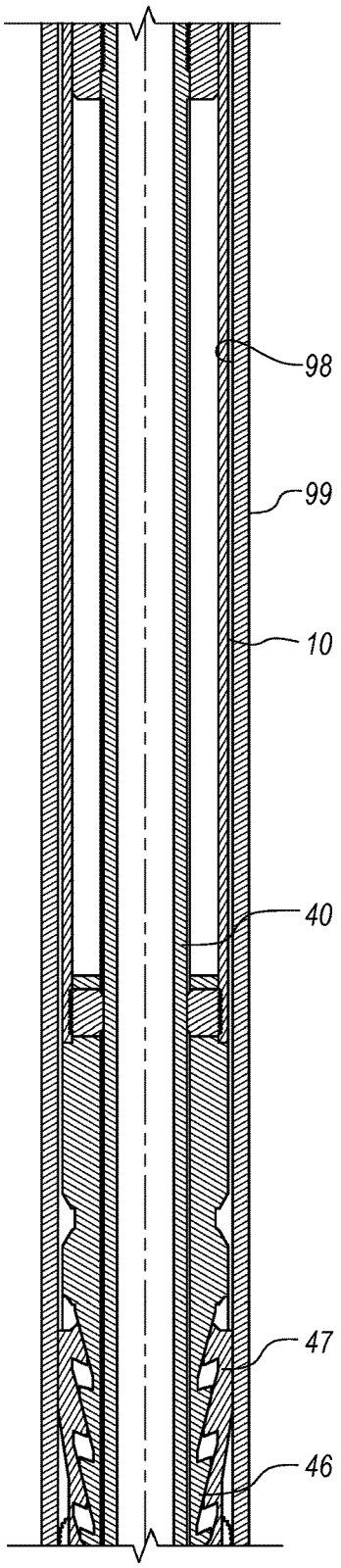
FIG. 10 is a sectional elevation view of the gripping section of the expansion tool of the present invention with the slip actuator coupled to the housing and the slips in a deployed configuration to engage and grip the casing.

FIG. 10 is a sectional elevation view of the slips 47 and slip actuator 46 of the expansion tool 10 of the present invention with the slips 47 (also shown in FIG. 6 as being coupled to the ratchet rack 55) displaced from their original position and forced axially onto the slip actuator 46. The slips 47 are illustrated in FIG. 10 in a deployed configuration engaging and gripping the interior wall 98 of the casing 99 in which the expansion tool 10 is disposed. FIG. 10 corresponds to the relative positions of the first annular piston 48 and the adjacent second annular stop 118 illustrated in FIG. 9. FIG. 10 illustrates how the slips 47 of the expansion tool 10 are deployed at the onset of the pressurization of the bore 44 of the pulling mandrel 40 to secure the housing 11 of the expansion tool 10 within the casing 99 before the expander 87 is pulled through a distal portion of the expandable outer clad 62.

Figure 11:
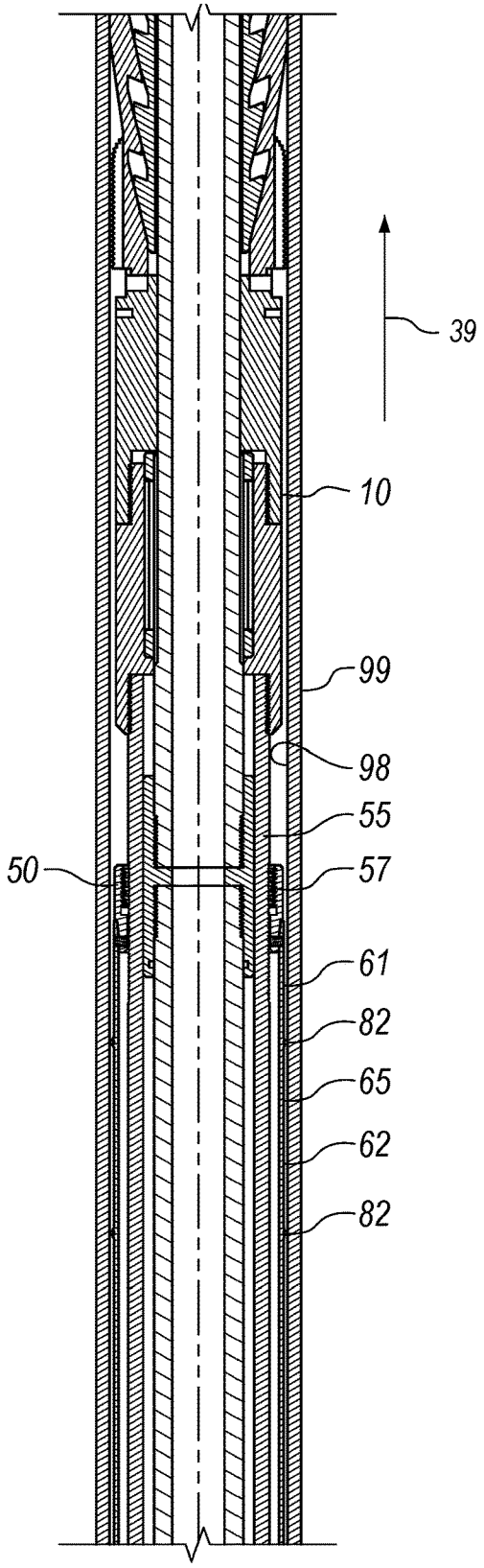
FIG. 11 is a sectional elevation view of a portion of the gripping section of the expansion tool in the gripping configuration of FIG. 10 and illustrates the coupling between the expandable outer clad, the ratcheting component, the ratchet rack, the rack retainer and the slips are intercoupled to deploy the gripping section of the expansion tool at the onset of an expansion stroke of the expansion tool.

FIG. 11 is a sectional elevation view of the slips 47 and slip actuator 46 of the expansion tool 10 and of the components of the reaction assembly that maintains the position of the expandable outer clad 62 during expansion. FIG. 11 illustrates how the expandable clad 62 and the components of the reaction assembly of the expansion tool 10 are coupled to deploy the slips 47 upon initial pressurization of the bore 44 of the pulling mandrel 40 for an expansion stroke. Optionally, the expandable outer clad 62 of FIG. 11 includes a plurality of elastomeric seals 82 disposed on the expandable outer clad 62 to engage and seal with the bore 98 of the casing 99 upon expansion of the expandable outer clad 62. The expandable outer clad 62, upon engagement at the distal end 64 (not shown—see FIGS. 7 and 8) by the expander 87, is urged against the ring housing 50 that houses the ratchet ring 57. The ratchet ring 57 cannot move along the ratchet rack 55 in the direction of arrow 39 due to the threaded arrangement (see FIG. 5) and the reaction force applied by the ring housing 50 to the axially compressed outer clad 62 as the force applied by the first expander 87 to the outer clad 62 is transferred through the ring housing 50 and the ratchet ring 57 housed therein to the ratchet rack 55. The ratchet rack 55 is coupled to the rack retainer 52 and the force applied by the ratchet ring 57 to the ratchet rack 55 is transferred through the rack retainer 52 to the slips 47, causing them to move in the axial direction of arrow 39 into the deployed and gripping configuration illustrated in FIG. 11.

Once the slips 47 engage the casing 99, the continued introduction of pressurized fluid into the bore of the pulling mandrel causes the pulling mandrel 40 to be displaced in a proximal direction within the bore of the housing 11 and to pull the first expander 87 into the bore of the distal end 64 of the outer clad 62. The resulting expansion of the expandable outer clad 62 continues until the stroke of the annular pistons 48 and 148 is completed. At this juncture, the first expander 87 is securely lodged within the partially expanded bore of the expandable outer clad 62 and the exterior surface of the expandable outer clad 62, in the portion of the expandable outer clad 62 that has been expanded, is in engagement with the casing 99.

The remaining unexpanded portion of the expandable outer clad 62 that has not yet been expanded by movement of the first expander 87 through the bore of the distal end 64 of the expandable outer clad 62 can be expanded by subsequent strokes of the expansion tool 10. Subsequent strokes require that the expansion tool 10 be re-cocked to reset the hydraulic section of the expansion tool 10, which means that the pulling mandrel 40 and the annular pistons 48 and 148 thereon must be restored to their original "run-in" positions relative to the housing 11 and the annular chambers defined by the stops 18 and 118 provided within the housing 11 for reciprocal movement of the annular pistons 48 and 148.

The expansion tool 10 can be re-cocked by first relieving the fluid pressure within the bore 44 of the pulling mandrel 40 to relieve force applied to each of the annular pistons 48 and 148 disposed on the pulling mandrel 40 by the fluid pressure within each of the annular chambers defined by the stops 18 and 118. It will be understood that relieving the pressure within the bore 44 of the pulling mandrel 40 requires control of the pumps that pump fluid into the bore 44 of the pulling mandrel 40 by pumping down the tubular string to the housing 11. With the hydraulic pressure in the bore 44 of the pulling mandrel 40 relieved, and with the first expander 87 securely lodged within the partially expanded expandable outer clad 62, the expanded portion of which engages the casing 99, the expansion tool 10 can be re-cocked by using the draw works on the rig to pull the tubular string (not shown) and the proximal end 12 of the housing 11 of the expansion tool 10 to which it is threadably connected in a proximal direction within the casing 99 to displace the annular pistons 48 and 148 back to their original locations within the annular chambers defined by the annular stops 18 and 118 of the proximally displaced housing 11. It will be understood that the pulling mandrel 40 and the first expander 87 to which it is connected will remain stationary during the re-cocking process, and also that the ball 72 does not disengage the ball seat 75 during this re-cocking step as long as the pressure within the bore 44 of the pulling mandrel 40 does not fall below the pressure within the casing 99. Once the housing 11 of the expansion tool 10 is displaced relative to the pulling mandrel 40 and the first expander 87 by using the draw works to pull the proximal end 12 of the housing 11, the expansion tool 10 is re-cocked and ready for being hydraulically stroked to set the slips 47 and then to expand an additional interval of the expandable outer clad 62.

Subsequent pressurization of the tubular string and of the bore 44 of the pulling mandrel 40 causes the slips 47 to again be engaged to grip the casing 99, and further pressurization causes the first expander 87 to be drawn in a proximal direction further within the bore of the expandable outer clad 62 to expand another portion of the expandable outer clad 62. It will be understood that with each stroke of the expansion tool 10, the axial length of the expanded portion of the expandable outer clad 62 increases. It will be further understood that since the expanded portion of the expandable outer clad 62 engages the casing 99, each stroke of the expansion tool 10 increases the overall surface area of frictional engagement between the exterior surface of the expanded portion of the expandable outer clad 62 and the casing 99 in which the expandable outer clad 62 is installed. It will be further understood that the expandable outer clad 62 is initially, during the early stages of expansion of the expandable outer clad 62, secured in place by the ratchet ring 57, the ring housing 50 and the ratchet rack 55, and by the arrangement of buttress threads within the bore of the ratchet ring 57 and on the exterior surface of the ratchet rack 55. However, once a sufficient amount of frictional engagement between the expanded portion of the expandable outer clad 62 and the casing 99 exists, the ratchet ring 57 and cooperating ratchet rack 55 will no longer continue to be loaded during strokes of the first expander 87 within the bore of the expandable outer clad 62 since movement of partially expanded expandable outer clad 62 within the casing 99 will be prevented by the steadily increasing frictional engagement between the expanded portion of the expandable outer clad 62 and the casing 99 in which it is expanded. At some point during the expansion of the expandable outer clad 62, the use of the hydraulic components (annular pistons 48 and 148, annular chambers defined by stops 18 and 118, etc.) and the gripping components (slips 47 and slip actuator 46) of the expansion tool 10 can be terminated, and the draw works of the rig from which the tubular string is run can be used to pull the expansion tool 10 and the first expander 87 coupled thereto to expand the remaining unexpanded portion of the partially expanded outer clad 62. If the weight on the draw works were to exceed a safe threshold beyond which the draw works or the tubular string may be damaged, the hydraulic components such as the annular pistons 48 and 148 and the annular stops 18 and 118, and the gripping components of the expansion tool 10 such as the slips 47 and the slip actuator 46 can be again engaged to continue expanding the expandable outer clad 62 one stroke at a time.

One embodiment of the method of the present invention includes the step of providing elastomeric seals 82 on the exterior surface 65 of the expandable outer clad 62 to engage the casing 99 upon expansion of the expandable outer clad 62. FIG. 11 illustrates a plurality of elastomeric seals 82 disposed on the expandable outer clad 62 near the proximal end 61 of the expandable outer clad 62. It will be understood that these seals 82 can be installed at a plurality of locations along the exterior surface 65 of the expandable outer clad 62 to engage the casing 99 upon expansion of the expandable outer clad 62 and to thereby provide additional sealing integrity.

Figure 12:
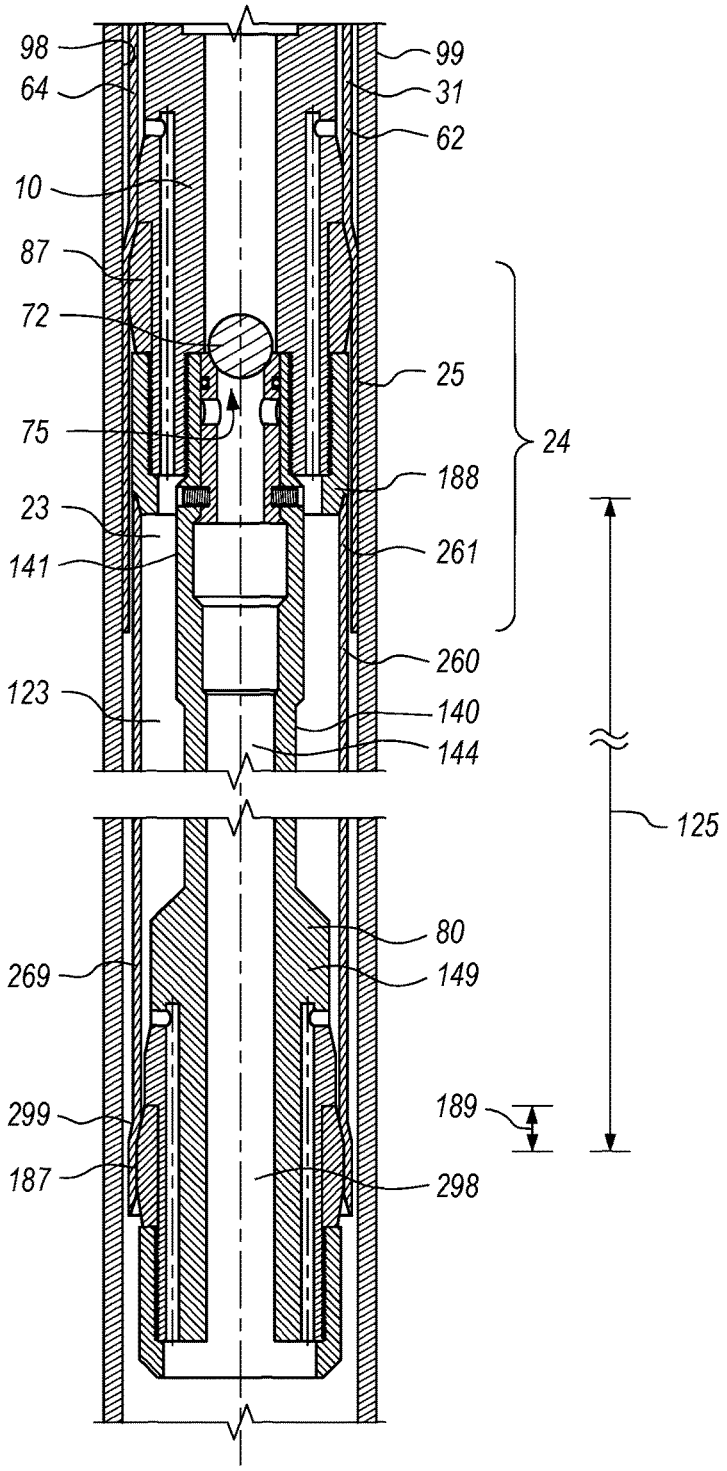
FIG. 12 is a sectional view of a distal portion 80 of the expansion tool 10 of the present invention, shown in the lower portion of FIG. 12, and the intermediate portion 73 of FIG. 7 shown in the upper portion of FIG. 12 to illustrate the interaction between the expandable inner clad 260, the second expander 187 and the pulling mandrel extension 144 of the expansion tool 10, on the one hand, and the expanded portion 25 of the outer clad 62, the first expander 87 and the pulling mandrel 40, on the other hand.

FIG. 12 is a sectional view of a distal portion 80 of the expansion tool 10 of the present invention, shown in the lower portion of FIG. 12, and the intermediate portion 73 of FIG. 7 shown in the upper portion of FIG. 12 to illustrate the interaction between the expandable inner clad 260, the second expander 187 and the pulling mandrel extension 144 of the expansion tool 10, on the one hand, and the expanded portion 25 of the outer clad 62, the first expander 87 and the pulling mandrel 40, on the other hand. The inner clad 260 includes a proximal end 261, a distal end 269 and a pre-expanded portion 299 at the distal end 269 of the inner clad 260. The pre-expanded portion 299 of the inner clad 260 shown in the lower portion of FIG. 9 is too large in diameter to enter the expanded portion 25 of the outer clad 62 shown in the upper portion of FIG. 9. That relative sizing between the pre-expanded portion 299 of the inner clad 260 and the expanded portion 25 of the outer clad 62 serves an important purpose, as will be discussed in more detail below. The remaining portion of the inner clad 260, the portion above the pre-expanded portion 299 of the inner clad 260, is advantageously small enough to be received into the bore 23 of the expanded portion 25 of the outer clad 62 as the outer clad 62 is progressively expanded, from distal end 64 to the proximal end 61, by movement of the first expander 87 being drawn through the outer clad 62 by the pulling mandrel 40. The pulling mandrel extension 140 includes a proximal end 141 that is coupled to the first expander 87, a bore 144 that extends the bore 44 of the pulling mandrel 40, and a distal end 149 that is coupled to the second expander 187. The inner clad 260 is axially captured intermediate the second expander 187, which is engaged with and lodged in the pre-expanded portion 299 of the inner clad 260, and the first expander 87, with the pulling mandrel extension 140 disposed within the bore 123 of the inner clad 260. Unlike the outer clad 62, the inner clad 260 is positioned for expansion by engagement of the pre-expanded portion 299 with the expanded distal end 64 of the outer clad 62 (instead of by use of a ratcheting component). While FIG. 12 illustrates the length of the inner clad 260 as being equal to the distance 125 from the retainer 188 (that secures the first expander 87 in place on the pulling mandrel 40) to the second expander 187, it will be understood that the inner clad 260 may be shorter in length than the distance 125. In one embodiment, the length of the unexpanded inner clad 260 is equal to the length of the unexpanded outer clad 62 plus the length 189 of the pre-expanded portion 299 of the distal end 269 of the inner clad 260. This length combination ensures that the expanded outer clad 62 and the expanded portion 25 of the inner clad 260 installed therein, which is the portion of the inner clad 260 above the pre-expanded portion 299, will be about the same length. It will be understood that the lengths of the inner clad 260 and the outer clad 62 may vary in other embodiments.

Figure 13:
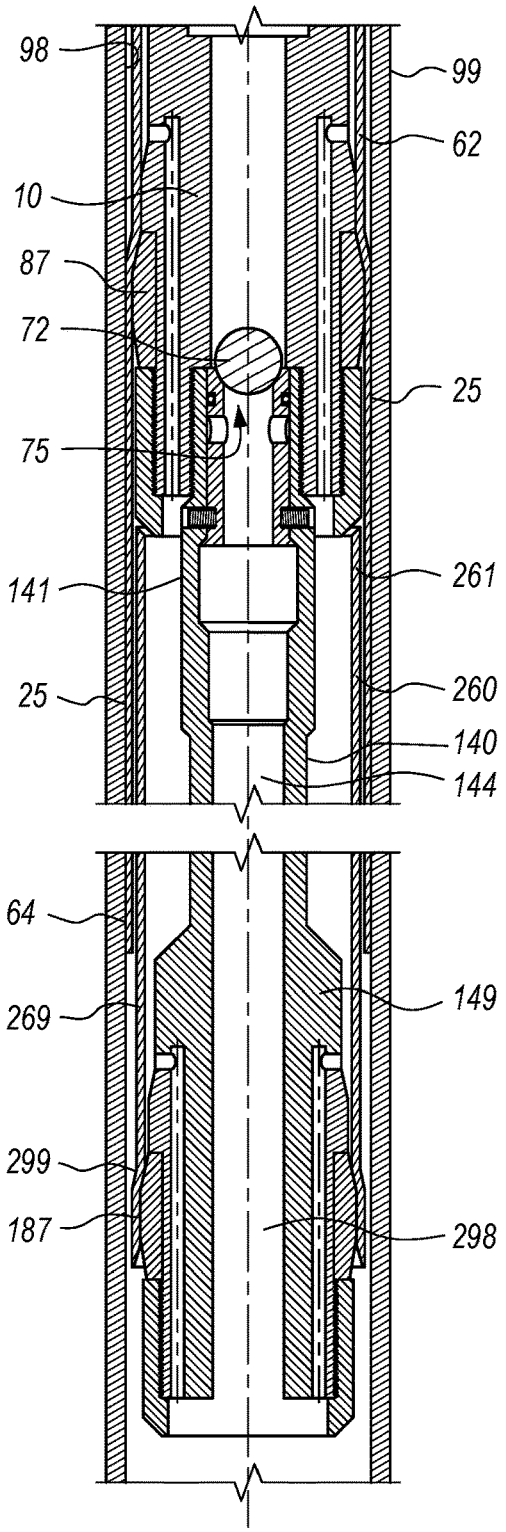
FIG. 13 is the view of the expansion tool of FIG. 12 after the first expander is pulled further through the outer clad to lengthen the expanded portion of the outer clad and to move a substantial portion, including the proximal end, of the unexpanded inner clad into the bore of the expanded portion of the outer clad.

FIG. 13 is the view of the expansion tool 10 of FIG. 12 after the first expander 87 is pulled further through the outer clad 62 to lengthen the expanded portion 25 of the outer clad 62 and to move a substantial portion, including the proximal end 261, of the unexpanded inner clad 260 into the bore of the expanded portion 25 of the outer clad 62. It can be seen in the lower portion of FIG. 13 that the distal end 64 of the outer clad 62, which was the first portion of the outer clad 62 to be expanded upon entry of the first expander 87 into the outer clad 62, is adjacent to the second expander 187 but not yet engaged by the pre-expanded portion 299 at the distal end 269 of the inner clad 260. It will be understood that as the second expander 187 and the pre-expanded portion 299 of the inner clad 260 into which the second expander 187 is received will continue to be drawn closer to the expanded distal end 64 of the expanded portion 25 of the outer clad 62 as the pulling mandrel 40, the first expander 87, the pulling mandrel extension 140, the pre-expanded portion 299 of the inner clad 260 and the second expander 187 lodged therein continue to be moved upwardly relative to the outer clad 62 and the casing 99 engaged by the expanded outer clad 62. It will be noted that there remains clearance between the unexpanded inner clad 260 and the expanded outer clad 62 to accommodate expansion of the inner clad 260 by the second expander 187 after the pre-expanded portion 299 of the inner clad engages the distal end 64 of the outer clad 62.

Figure 14:
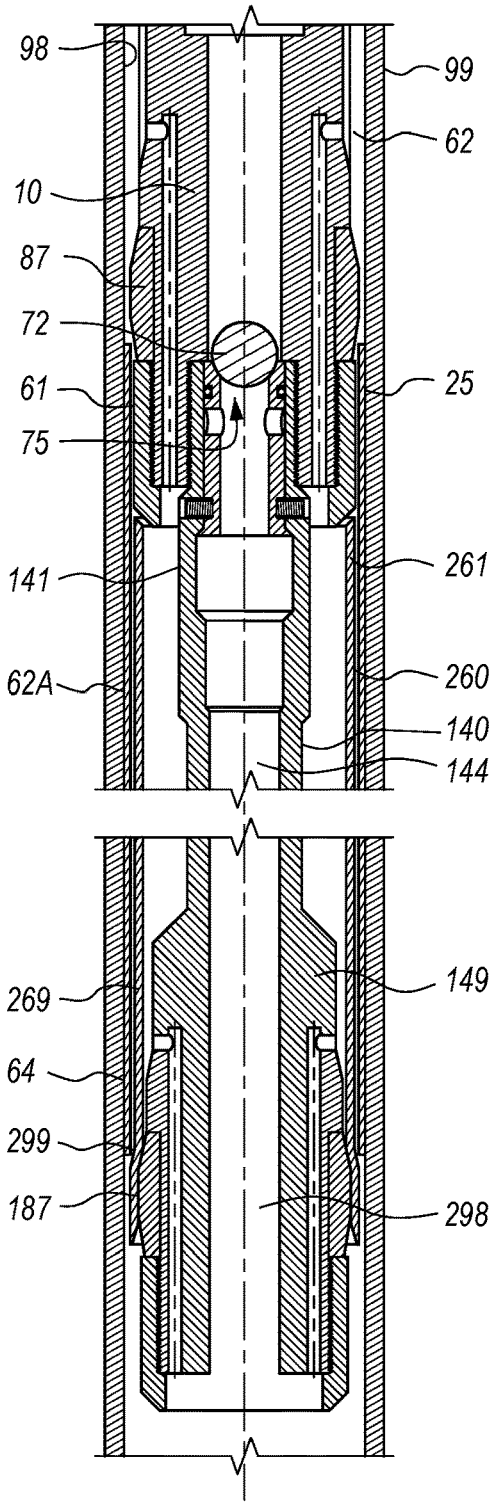
FIG. 14 is the view of the expansion tool of FIG. 13 after the first expander is pulled further through the outer clad to lengthen the expanded portion of the outer clad and to move all of the inner clad except the pre-expanded portion into the bore of the expanded portion of the outer clad.

FIG. 14 is the view of the expansion tool 10 of FIG. 13 after the first expander 87 is pulled further through the outer clad 62 to lengthen the expanded portion 25 of the outer clad 62 and to move all of the inner clad 260 except the pre-expanded portion 299 into the bore of the expanded portion 25 of the outer clad 62. It can be seen in the lower portion of FIG. 14 that the distal end 64 of the outer clad 62, which was the first portion of the outer clad 62 to be expanded upon entry of the first expander 87 into the outer clad 62, is engaged by the pre-expanded portion 299 at the distal end 269 of the inner clad 260, and that the second expander 187 is lodged within the pre-expanded portion 299 of the inner clad 260. The first expander 87 has emerged from the now-expanded proximal end 61 of the outer clad 62. It will be understood that as the second expander 187 continues to be pulled upwardly by continued movement of the pulling mandrel 40, the first expander 87 and the pulling mandrel extension 140, the pre-expanded portion 299 of the inner clad 260 will not enter the bore of the now fully expanded outer clad 62 because there is insufficient annular clearance between the bore of the expanded outer clad 62 and the second expander 187. As a result, the movement of the inner clad 260 will stop at the position illustrated in FIG. 14, and the second expander 187 will be drawn into the bore of the inner clad 260 to expand the inner clad 260 radially outwardly to engage the bore of the outer clad 62 and to close the clearance between the bore of the outer clad 62 and the inner clad 260 that is shown in FIG. 14.

Figure 15:
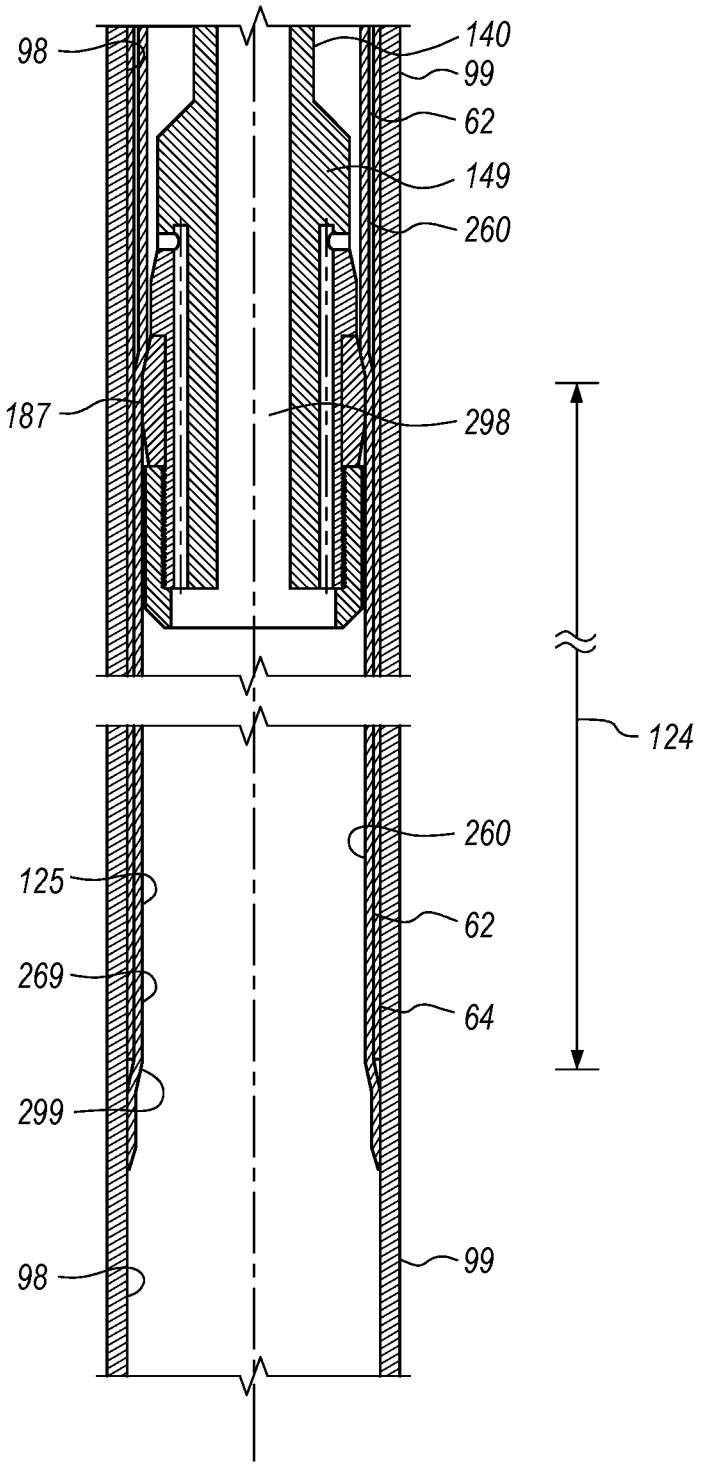
FIG. 15 is the view of FIG. 14 after the second expander is pulled by movement of the pulling mandrel, the first expander and the pulling mandrel extension through an expanded portion of the inner clad having a length.

FIG. 15 is the view of FIG. 14 after the second expander 187 is pulled by movement of the pulling mandrel 40, the first expander 87 and the pulling mandrel extension 140 through an expanded portion 125 of the inner clad 260 having a length 124. It will be understood that further upwardly movement of the pulling mandrel 40, the first expander 87, the pulling mandrel extension 140 and the second expander 187 will result in further expansion of the inner clad 260 until the second expander 187 exits the proximal end 261 (not shown in FIG. 15) of the inner clad 260 to complete the installation of the tandem clad liner comprising the expanded outer clad 62 and the expanded inner clad 260 therein. It will be noted that the pre-expanded portion 299 of the inner clad 260 remains engaged with the distal end 64 of the expanded outer clad 62.

Figure 16:
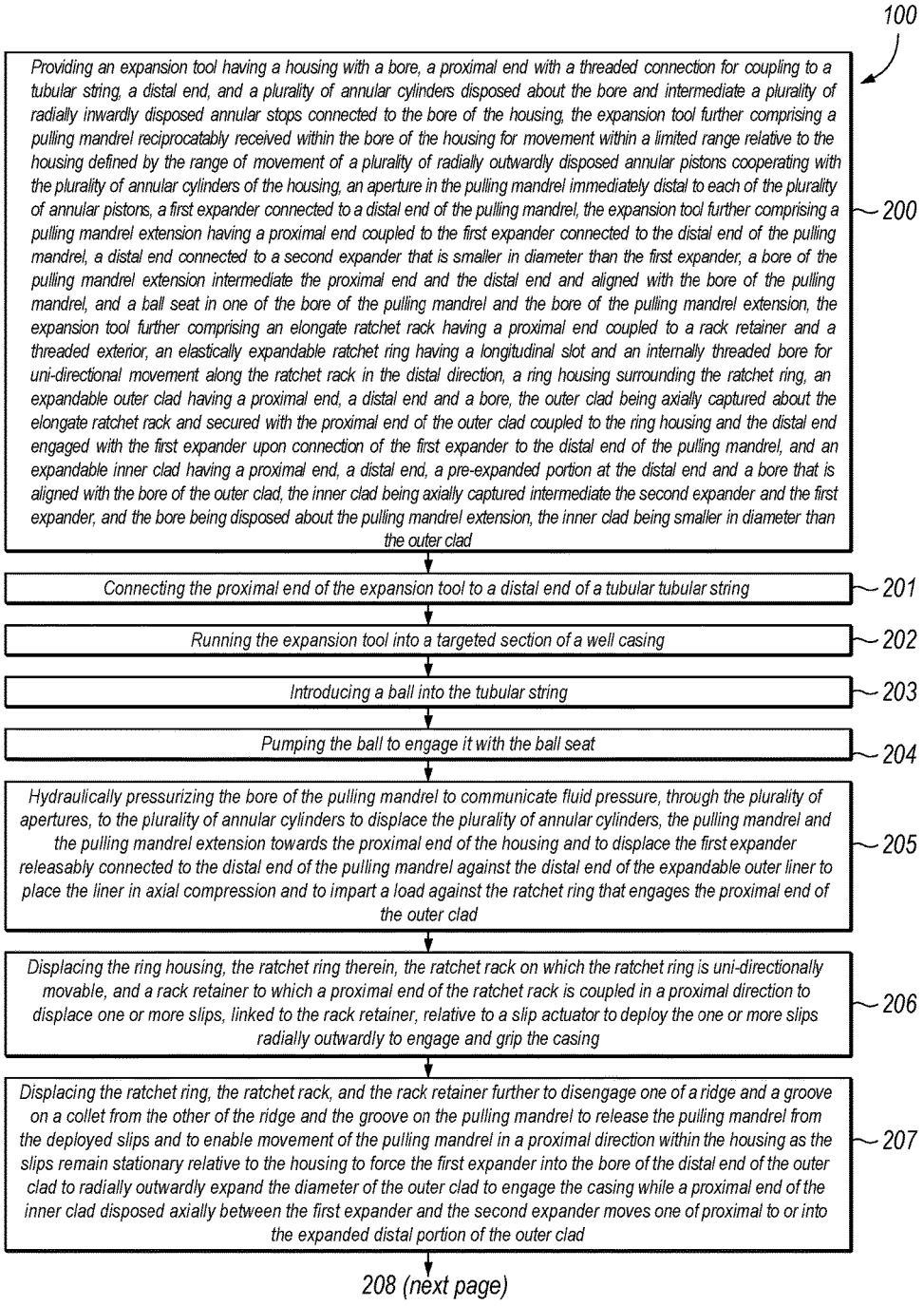
FIG. 16 is a high-level flowchart illustrating the steps of a method of expanding a liner within a targeted interval of a casing using an embodiment of a liner expansion tool.
Figure 16:
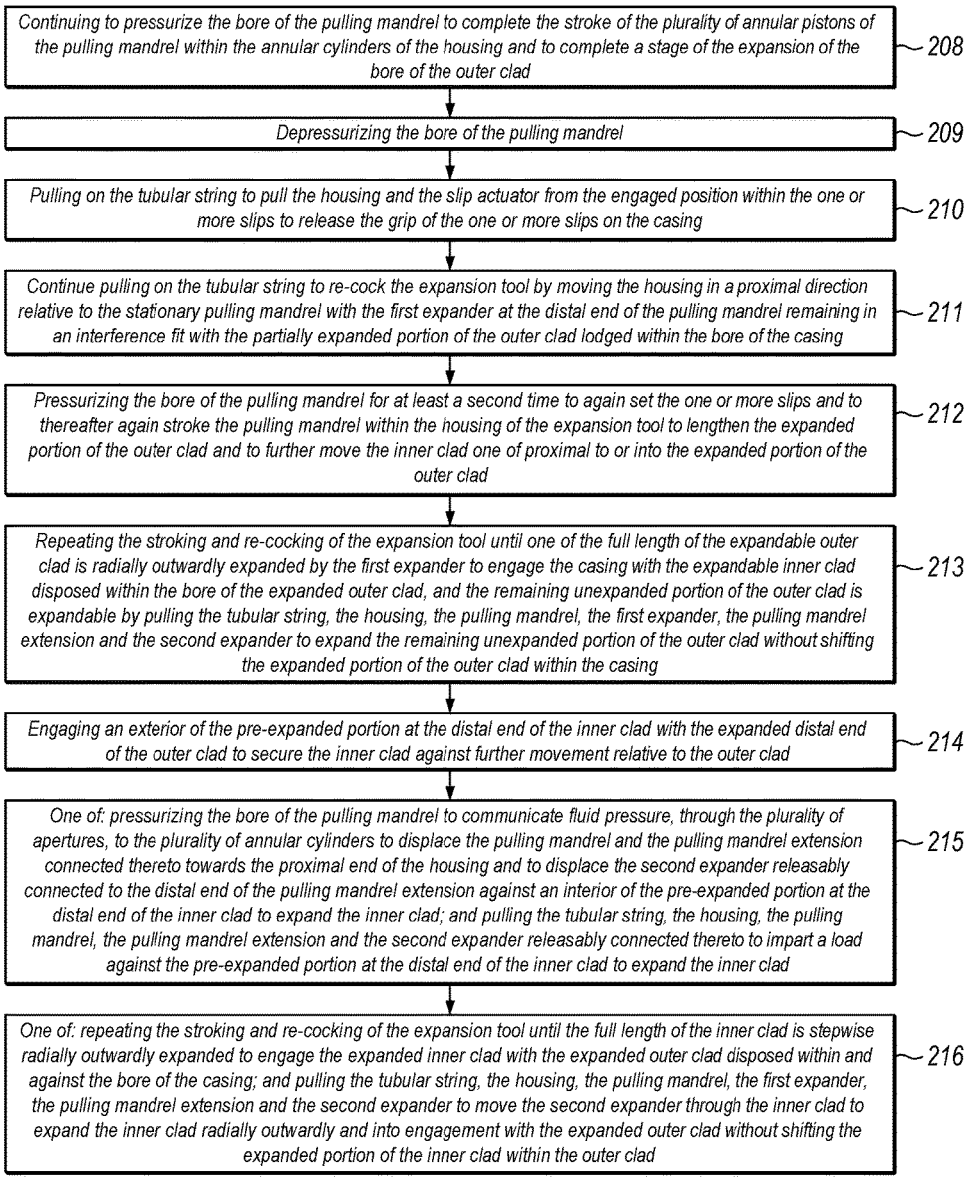

FIG. 16 is a high level flow chart illustrating the steps of an embodiment of a method 100 of the present invention for installing an expandable liner 62 within a casing 99. These steps are clearly related to the use of the liner expansion tool 10 illustrated in FIGS. 1-15 as well as other embodiments of the liner expansion tool 10 of the present invention.

The terminology used herein is for the purpose of describing particular embodiments only and is not intended to be limiting of the invention. As used herein, the term "outer clad" is used to refer to a tubular liner adapted for being expanded within a bore of an interval of casing targeted for being lined using a tandem liner. As used herein, the term "inner clad" is used to refer to a tubular liner adapted for being expanded within the expanded outer clad, excepting the pre-expanded portion at the end of the inner clad.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof.

The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method, comprising:

providing an expansion tool, wherein the expansion tool comprises:

a housing with a bore, a proximal end with a threaded connection for coupling to a tubular string, a distal end, and a plurality of annular cylinders, wherein each annular cylinder of the plurality of annular cylinders is disposed about the bore of the housing and intermediate two adjacent annular stops of a plurality of annular stops, the plurality of annular stops being connected to and disposed radially inwardly with respect to the bore of the housing;

a pulling mandrel reciprocatably received within the bore of the housing for movement within a limited range relative to the housing defined by a range of movement of a plurality of annular pistons disposed radially outwardly with respect to the pulling mandrel and cooperating with the plurality of annular cylinders, the pulling mandrel having a plurality of apertures formed therein, each aperture of the plurality of apertures being located immediately distal to a corresponding annular piston of the plurality of annular pistons, wherein a first expander is connected to a distal end of the pulling mandrel;

a pulling mandrel extension connected to the distal end of the pulling mandrel and having a proximal end coupled to the first expander, a distal end connected to a second expander that is smaller in diameter than the first expander, a bore of the pulling mandrel extension intermediate the proximal end and the distal end and aligned with the bore of the pulling mandrel, and a ball seat in one of the bore of the pulling mandrel or the bore of the pulling mandrel extension;

an elongate ratchet rack having a proximal end coupled to a rack retainer and a threaded exterior;

an elastically expandable ratchet ring having a longitudinal slot and an internally threaded bore for uni-directional movement along the ratchet rack in the distal direction;

a ring housing surrounding the ratchet ring;

an expandable outer clad having a proximal end, a distal end and a bore, the outer clad being axially captured about the elongate ratchet rack and secured with the proximal end of the outer clad coupled to the ring housing and the distal end of the outer clad engaged with the first expander upon connection of the first expander to the distal end of the pulling mandrel; and an expandable inner clad having a proximal end, a distal end, a pre-expanded portion at the distal end, and a bore that is aligned with the bore of the outer clad, the inner clad being axially captured intermediate the second expander and the first expander, and the bore of the inner clad being disposed about the pulling mandrel extension, the inner clad being smaller in diameter than the outer clad;

connecting the proximal end of the expansion tool to a distal end of a tubular string;

running the expansion tool into a targeted section of a well casing;

introducing a ball into the tubular string;

pumping the ball to engage it with the ball seat;

hydraulically pressurizing the bore of the pulling mandrel to communicate fluid pressure, through the plurality of apertures, to the plurality of annular cylinders to displace the plurality of annular pistons, the pulling mandrel, and the pulling mandrel extension towards the proximal end of the housing and to displace the first expander releasably connected to the distal end of the pulling mandrel against the distal end of the expandable outer clad to place the outer clad in axial compression and to impart a load against the ratchet ring that engages the proximal end of the outer clad;

displacing the ring housing, the ratchet ring therein, the ratchet rack on which the ratchet ring is uni-directionally movable, and a rack retainer to which a proximal end of the ratchet rack is coupled in a proximal direction to displace one or more slips, linked to the rack retainer, relative to a slip actuator to deploy the one or more slips radially outwardly to engage and grip the well casing;

displacing the ratchet ring, the ratchet rack, and the rack retainer further to disengage a collet from the pulling mandrel to release the pulling mandrel from the deployed slips and to enable movement of the pulling mandrel in a proximal direction within the housing as the slips remain stationary relative to the housing to force the first expander into the bore of the distal end of the outer clad to radially outwardly expand the diameter of the outer clad to engage the well casing while a proximal end of the inner clad disposed axially between the first expander and the second expander moves one of proximal to or into the expanded distal portion of the outer clad;

continuing to pressurize the bore of the pulling mandrel to complete the stroke of the plurality of annular pistons of the pulling mandrel within the plurality of annular cylinders of the housing and to complete a stage of expansion of the bore of the outer clad;

depressurizing the bore of the pulling mandrel;

pulling on the tubular string to pull the housing and the slip actuator from an engaged position within the one or more slips to release the grip of the one or more slips on the well casing;

continuing to pull on the tubular string to re-cock the expansion tool by moving the housing in a proximal direction relative to the pulling mandrel with the first expander at the distal end of the pulling mandrel remaining in an interference fit with an expanded portion of the outer clad lodged within the bore of the well casing;

pressurizing the bore of the pulling mandrel for at least a second time to again set the one or more slips and to thereafter again stroke the pulling mandrel within the housing of the expansion tool to lengthen the expanded portion of the outer clad and to further move the inner clad one of proximal to or into the expanded portion of the outer clad;

repeating the stroking and re-cocking of the expansion tool until one of a full length of the expandable outer clad is radially outwardly expanded by the first expander to engage the well casing with the expandable inner clad disposed within the bore of the expanded outer clad, or a remaining unexpanded portion of the outer clad is expandable by pulling the tubular string, the housing, the pulling mandrel, the first expander, the pulling mandrel extension, and the second expander to expand the remaining unexpanded portion of the outer clad without shifting the expanded portion of the outer clad within the well casing;

engaging an exterior of the distal end of the inner clad with the expanded distal end of the outer clad to secure the inner clad against further movement relative to the outer clad; and one of pressurizing the bore of the pulling mandrel to communicate fluid pressure, through the plurality of apertures, to the plurality of annular cylinders to displace the pulling mandrel and the pulling mandrel extension connected thereto towards the proximal end of the housing and to displace the second expander releasably connected to the distal end of the pulling mandrel extension against an interior of the pre-expanded portion at the distal end of the inner clad to expand the inner clad, and pulling the tubular string, the housing, the pulling mandrel, the pulling mandrel extension, and the second expander releasably connected thereto to impart a load against the pre-expanded portion at the distal end of the inner clad to expand the inner clad;

one of: repeating the stroking and re-cocking of the expansion tool until a full length of the inner clad is stepwise radially outwardly expanded to engage the expanded outer clad with the expanded outer clad disposed within and against the bore of the well casing, or pulling the tubular string, the housing, the pulling mandrel, the first expander, the pulling mandrel extension and the second expander to move the second expander through the inner clad to expand the inner clad radially outwardly and into engagement with the expanded outer clad without shifting the expanded portion of the inner clad within the outer clad.

2. The method of claim 1, wherein the internally threaded bore of the ratchet ring includes a plurality of buttress threads; and wherein the threaded exterior surface of the ratchet rack includes buttress threads that cooperate with the buttress threads of the ratchet ring.

3. The method of claim 1, wherein the collet comprises at least one ridge or at least one groove on a collet finger;

the pulling mandrel comprises at least one groove to engage the at least one ridge on the collet finger, or at least one ridge to engage the at least one groove on the collet finger;

wherein the collet is surrounded by a collet cage;

wherein stroking the pulling mandrel to engage the rack retainer against the collet cage displaces the slips from a retracted position to a deployed position engaged with the well casing; and wherein continuing to stroke the pulling mandrel dislodges the pulling mandrel from the collet to thereby permit movement of the pulling mandrel relative to the collet and the collet cage.

4. The method of claim 3, further including:

re-engaging the collet finger and the pulling mandrel during the re-cocking of the expansion tool.

5. The method of claim 4, wherein the expander is threadably connected to the distal end of the pulling mandrel.

6. An expansion tool for installing a tandem clad liner within a well casing, comprising:

an elongate pulling mandrel having a proximal end, a distal end connected to a first expander, a bore, a plurality of annular pistons radially outwardly extending from an exterior wall of the pulling mandrel intermediate the proximal end and the distal end, a ball seat within the bore of the pulling mandrel intermediate the distal end and the plurality of annular pistons, and a plurality of apertures through a wall of the pulling mandrel, each aperture disposed distal to one of the plurality of annular pistons;

an elongate pulling mandrel extension having a proximal end coupled to the first expander, a distal end connected to a second expander, and a bore aligned with and in fluid communication with the bore of the pulling mandrel;

an elongate housing having a proximal end, a distal end, a bore to receive the pulling mandrel, and a plurality of radially inwardly extending stops intermediate the proximal end and the distal end to divide the elongate housing into a plurality of annular cylinders, wherein each cylinder of the plurality of cylinders is located between an adjacent pair of stops of the plurality of stops, wherein each annular piston of the plurality of annular pistons is reciprocatable within a corresponding cylinder of the plurality of cylinders, the proximal end of the housing having a threaded connection for sealably securing the expansion tool to a distal end of a tubular string supported at a proximal end by a rig, the rig having a draw works for use in stepwise extending the tubular string to position the expansion tool within the well casing and for providing pressurized fluid through the tubular string to the expansion tool;

a rack retainer having a bore to receive the pulling mandrel and a proximal end to engage one or more slips angularly distributed about the pulling mandrel, the one or more slips being radially movable by engagement of the rack retainer between a radially retracted position and a radially outwardly deployed position to grip the interior bore of the well casing in which the expansion tool is disposed;

an elongate ratchet rack having a proximal end coupled to the rack retainer, a distal end, and a bore through which a lower portion of the pulling mandrel extends, the ratchet rack having an exterior with a plurality of buttress threads;

a ratchet ring having a bore with buttress threads for cooperating with the exterior of the ratchet rack, the ratchet ring expandably disposed within a ring housing, the ratchet ring further including a longitudinal slot to enable the ratchet ring to elastically circumferentially expand and contract as the buttress threads of the interior bore of the ratchet ring slidably engage the buttress threads along the exterior of the ratchet rack and as the ratchet ring is moved in a distal direction relative to the ratchet rack, the ratchet ring and ratchet rack being buttress threaded to resist movement of the ratchet ring relative to the ratchet rack in a proximal direction;

an expandable outer clad having a proximal end engaged with the ring housing, a distal end that is one of engaged with or proximal to the first expander, and a bore therebetween, the expandable outer clad being receivable onto the expansion tool by insertion of the elongate ratchet rack into the bore of the expandable outer clad until the proximal end of the outer clad engages the ring housing that surrounds the ratchet ring on the exterior of the ratchet rack, the outer clad being securable on the expansion tool by connection of the first expander to the distal end of the pulling mandrel to capture the outer clad axially intermediate the first expander and the ring housing;

an expandable inner clad having a proximal end, a distal end, and a bore therebetween, wherein the expandable inner clad has a pre-expanded portion at the distal end of the expandable inner clad, the expandable inner clad being receivable onto the expansion tool by insertion of the elongate pulling mandrel extension into the bore of the expandable inner clad and securing of the inner clad onto the expansion tool by connection of the second expander to the distal end of the pulling mandrel extension to axially capture the inner clad intermediate the second expander and the first expander;

an annular slip actuator having a proximal end engaged with the housing and having a plurality of sloped slip lobes on a radially outer surface; and one or more slips disposed radially outwardly of the annular slip actuator and radially movable by the slip actuator from a retracted position to a radially outwardly deployed position to grip a bore of the well casing in which the expansion tool is disposed to secure the housing of the expansion tool in position within the well casing.

7. The apparatus of claim 6, wherein the threads within the bore of the ratchet ring and the threads on the exterior of the ratchet rack are buttress threads having a steep load-bearing face on a first side of each thread and a ramped face on an opposite side of each thread to provide for elastic spreading of the slot of the ratchet ring to enable thread-skipping movement of the ratchet ring in a distal direction relative to the ratchet rack.

8. The expansion tool of claim 6, wherein the introduction of a sufficient hydraulic pressure into the bore of the pulling mandrel is communicated through the plurality of apertures in the pulling mandrel to the plurality of annular cylinders and axially intermediate each annular piston of the plurality of annular pistons and a corresponding annular stop of the plurality of annular stops and displaces the plurality of annular pistons, the pulling mandrel, and the first expander connected thereto in a proximal direction relative to the housing; and wherein displacement of the first expander in the proximal direction moves the expandable outer clad, the ratchet ring, the ratchet rack, and the rack retainer to engage and displace the slips radially outwardly against the slip actuator to grip the well casing, after which further movement of the pulling mandrel in the proximal direction pulls the first expander into the bore of the distal end of the outer clad to radially expand a portion of the outer clad to an expanded diameter as the outer clad is retained in position against the force applied by the first expander by the ratchet ring and the ratchet rack threadably engaged with the ratchet ring;

wherein the expansion tool is re-cocked by relieving the fluid pressure applied to the bore of the pulling mandrel, using the draw works on the rig to pull on the housing to unseat the slips from the well casing, and using the draw works on the rig to reposition the housing uphole as the pulling mandrel, the first expander connected thereto and the annular pistons extending radially therefrom remain in a lodged position with the expanded diameter of the outer clad disposed circumferentially around the first expander and between the first expander and the well casing; and wherein the ratchet ring remains engaged with the bore of the proximal end of the outer clad as the housing is repositioned uphole with the ratchet rack, the ratchet ring then threadably engaging the ratchet rack at a new position distal to an original position of the ratchet ring on the ratchet rack to provide resistance to axial movement of the outer clad in response to a subsequent expansion stroke of the first expander.

9. The apparatus of claim 6, wherein the first expander is threadably connected to the distal end of the pulling mandrel.

* * * * *